US008405686B2

(12) United States Patent
Tanizoe et al.

(10) Patent No.: US 8,405,686 B2
(45) Date of Patent: Mar. 26, 2013

(54) DISPLAY DEVICE AND DISPLAY SYSTEM

(75) Inventors: Hideki Tanizoe, Tokyo (JP); Yoshihiro Ashizaki, Tokyo (JP); Nobuhiko Yamagishi, Tokyo (JP); Yoshitomo Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 615 days.

(21) Appl. No.: 12/650,293

(22) Filed: Dec. 30, 2009

(65) Prior Publication Data

US 2010/0201716 A1 Aug. 12, 2010

(30) Foreign Application Priority Data

Feb. 9, 2009 (JP) ..... 2009-026967

(51) Int. Cl.
*G09G 5/10* (2006.01)

(52) U.S. Cl. ..... 345/690

(58) Field of Classification Search ..... 345/7, 8, 345/88, 102, 156, 204, 207, 214, 556, 590, 345/600, 690; 348/607, 673, 739, 745, E5.066; 349/58–68, 114, 199

See application file for complete search history.

(56) References Cited

U.S. PATENT DOCUMENTS

| | | | | |
|---|---|---|---|---|
| 5,597,223 | A * | 1/1997 | Watanabe et al. | 353/97 |
| 5,952,992 | A | 9/1999 | Helms | |
| 6,853,854 | B1 * | 2/2005 | Proniewicz et al. | 600/319 |
| 7,071,987 | B1 * | 7/2006 | Tanaka | 348/362 |
| 7,220,006 | B2 * | 5/2007 | Allen et al. | 353/85 |
| 7,221,363 | B2 * | 5/2007 | Roberts et al. | 345/204 |
| 7,595,784 | B2 * | 9/2009 | Yamamoto et al. | 345/102 |
| 7,742,019 | B2 | 6/2010 | Takahara | |
| 7,869,848 | B2 * | 1/2011 | Proniewicz et al. | 600/319 |
| 7,924,248 | B2 | 4/2011 | Takahara | |
| 8,228,461 | B2 * | 7/2012 | Mizuuchi et al. | 349/62 |
| 2003/0043290 | A1 * | 3/2003 | Sasaki | 348/345 |
| 2003/0107681 | A1 * | 6/2003 | Otawara et al. | 348/673 |
| 2003/0214610 | A1 * | 11/2003 | George | 348/745 |
| 2004/0070565 | A1 | 4/2004 | Nayar et al. | |
| 2004/0202001 | A1 * | 10/2004 | Roberts et al. | 362/494 |
| 2005/0146651 | A1 * | 7/2005 | Whitted et al. | 349/58 |
| 2005/0168490 | A1 | 8/2005 | Takahara | |
| 2005/0171416 | A1 * | 8/2005 | Proniewicz et al. | 600/319 |
| 2005/0200944 | A1 * | 9/2005 | Kobayashi et al. | 359/333 |
| 2006/0007239 | A1 * | 1/2006 | Harrison | 345/590 |
| 2007/0256339 | A1 | 11/2007 | Fryer et al. | |
| 2008/0186393 | A1 | 8/2008 | Lee et al. | |
| 2009/0103578 | A1 * | 4/2009 | Seibert | 372/29.011 |
| 2009/0141286 | A1 * | 6/2009 | Kothari | 356/519 |

(Continued)

FOREIGN PATENT DOCUMENTS

| | | | |
|---|---|---|---|
| CN | 1912987 | A | 2/2007 |
| CN | 1938744 | A | 3/2007 |

(Continued)

*Primary Examiner* — Prabodh M Dharia

(74) *Attorney, Agent, or Firm* — Birch, Stewart, Kolasch & Birch, LLP.

(57) ABSTRACT

A display device according to the present invention includes a display which is provided on a front surface of the display device and is a display surface on which images are displayed, an illuminance sensor which is provided on a rear surface of the display device and is a first measuring unit measuring illuminance on the rear surface, and a control unit which is a first control unit controlling brightness of the images displayed on the display.

16 Claims, 21 Drawing Sheets

U.S. PATENT DOCUMENTS

| | | | | |
|---|---|---|---|---|
| 2009/0184984 | A1 | 7/2009 | Takahara | |
| 2009/0213145 | A1 * | 8/2009 | Onizawa | 345/690 |
| 2009/0262063 | A1 | 10/2009 | Fujine et al. | |
| 2010/0265277 | A1 | 10/2010 | Takahara | |

FOREIGN PATENT DOCUMENTS

| | | | |
|---|---|---|---|
| EP | 1445643 | A1 | 6/2004 |
| EP | 1 892 698 | A1 | 2/2008 |
| EP | 1950731 | A1 | 7/2008 |
| JP | 07-064499 | A | 3/1995 |
| JP | 9-146073 | A | 6/1997 |
| JP | 2003-208128 | A | 7/2003 |
| JP | 2006-72255 | | 3/2006 |
| JP | 2006-285064 | A | 10/2006 |
| JP | 2007-148064 | A | 6/2007 |
| JP | 2007-212820 | A | 8/2007 |
| JP | 2007-258785 | A | 10/2007 |
| JP | 2007-279179 | A | 10/2007 |
| JP | 2007-310096 | | 11/2007 |
| JP | 2008-276226 | A | 11/2008 |
| JP | 2009-025437 | A | 2/2009 |
| KR | 10-2008-0059447 | A | 6/2008 |

* cited by examiner

DISPLAY DEVICE AND DISPLAY SYSTEM

BACKGROUND OF THE INVENTION

1. Field of the Invention

The present invention relates to a display device and a display system which provide a unit for brightness adjustment in accordance with illuminance of an installation environment and contents of display images.

2. Description of the Background Art

In a conventional display device, a system which performs brightness adjustment of a display is configured as shown in FIG. 20. In FIG. 20, the system includes a liquid crystal panel 41, a backlight module 42 attached to the liquid crystal panel 41, an inverter circuit 43 connected to the backlight module 42, a power supply circuit 44 which supplies driving power to the inverter circuit 43 and a control circuit 45 whose output is connected to the inverter circuit 43. The backlight module 42 is composed of a plurality of cold cathode fluorescent lamps (CCFLs). The inverter circuit 43 drives the backlight module 42. The control circuit 45 controls a pulse width and a frequency of a driving waveform output to the inverter circuit 43, and controls power supplied from a power source to the inverter, to thereby control brightness of a screen.

Here, screen brightness is appropriately set by a user in accordance with input setting by an external communication unit such as a remote controller, a push button or the like, and a setting value thereof is stored in a nonvolatile memory inside a controller.

In this case, when illuminance around the display changes under use environment due to an effect of outside light or the like, eyes of a person are adapted to surrounding environment, which results in a decrease in visibility. In addition, when brightness is increased more than necessary, power is consumed uselessly.

As measures against the above-mentioned problems, there are a system which measures brightness around a display on a front side to automatically adjust brightness of a display (for example, see Japanese Patent Application Laid-Open No. 09-146073 (1997)), a system which measures an illuminance by a remote controller in addition to an illuminance of a liquid crystal display panel to use those illuminances for control (for example, see Japanese Patent Application Laid-Open No. 2006-72255), and a system which uses a plurality of sensors, which are installed around a screen, for control (for example, see Japanese Patent Application Laid-Open No. 2007-310096).

In the above-mentioned systems, illuminance sensors are provided on a display surface of the display or around the display surface, and there is provided a unit which directly measures light entering the display surface of the display or measures illuminance of a place apart from the display surface of the display. However, it is conceivable as shown in FIG. 21 that eyes of an actual user (observer) are adapted to light (background) which is caused to enter the display surface of the display from a direction with a rear surface of the display being as a center, not to light entering the display surface of the display.

Accordingly, in a case where sensors are installed on a display surface of a display, it may be difficult to perform accurate control adapted to a change of outside light in some cases.

For example, as shown in FIG. 22, in a case where large displays for information display are installed at a window of a building in a state of being suspended from a ceiling, eyes of an observer are adapted to outside light entering a display surface from the window, but are not necessarily adapted to a light source inside the building. In a case where a ratio of the display surface of the display with respect to a visual field of the observer is relatively small, that is, under most of installation environments of a display for public display, it is naturally considered that the eyes of the observer are not adapted to reflected light (generally, reflectance is 5% or less) of light entering the display surface of the display but adapted to reflected light on a wall behind the display, outside light from the window behind the display or the like (FIG. 21).

Therefore, there arises a problem that a conventional display device cannot accurately obtain an effect of ambient light and be adapted thereto.

Further, in a case where displays individually perform an operation of correcting outside light in a system in which a single large screen is formed using a plurality of display devices, there arises a problem that differences (variations) are caused in brightness control for displays due to variations in sensor for measuring outside light or differences in setting position.

SUMMARY OF THE INVENTION

The present invention has been made to solve the above-mentioned problems, and an object thereof is to provide a display device which accurately obtains an effect of ambient light, performs control in accordance with the effect, and performs brightness control free from brightness unevenness of a display.

A display device according to the present invention includes a display surface, a first measuring unit and a first control unit. The display surface is provided on a front surface of the display device, on which images are displayed. The first measuring unit is provided on a rear surface of the display device and measures illuminance on the rear surface. The first control unit performs brightness control on the images displayed on the display surface in accordance with a measurement result of the first measuring unit.

The display device includes the first measuring unit which measures the illuminance on the rear surface and the first control unit which performs the illuminance control on the images displayed on the display surface in accordance with the measurement result of the first measuring unit. Accordingly, it is possible to measure light entering the rear surface of the display, perform brightness control adapted thereto, and perform brightness control corresponding to an adaptation state of eyes of an observer.

These and other objects, features, aspects and advantages of the present invention will become more apparent from the following detailed description of the present invention when taken in conjunction with the accompanying drawings.

DESCRIPTION OF THE PREFERRED EMBODIMENTS

A. First Preferred Embodiment

(A-1. Configuration)

Figure 1:
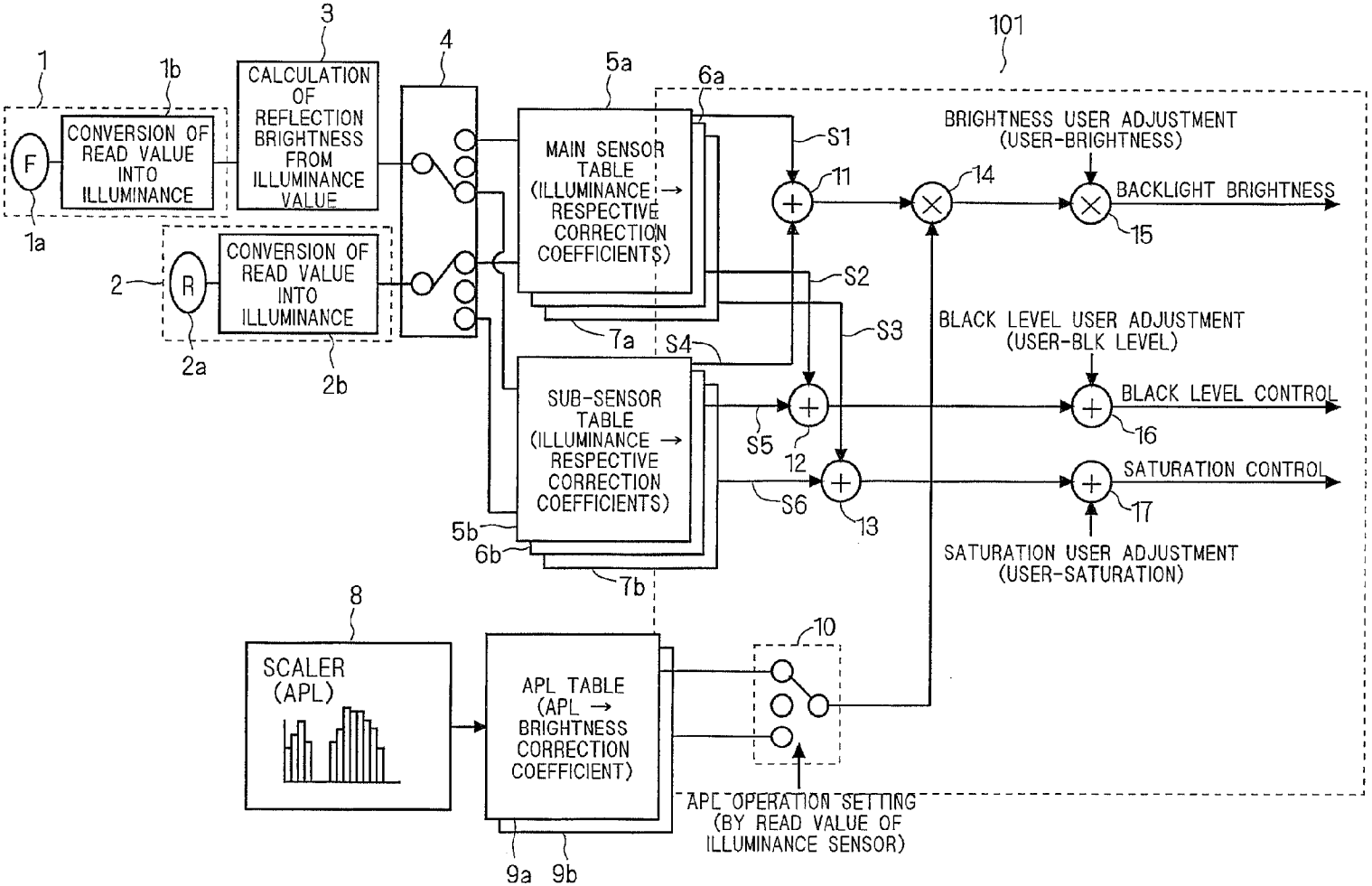
FIG. 1 is a system configuration diagram of a display device according to a first preferred embodiment of the present invention.

FIG. 1 is a configuration diagram of a display device according to a first preferred embodiment of the present invention. A brightness adjusting system of the display device according to the present invention includes: at least one illuminance sensor 1 installed on a display side being a display surface included in the display device, which is a second measuring unit; at least one illuminance sensor 2 installed on a back surface (rear surface) of the display of the display device, which is a first measuring unit; a calculating unit 3 which calculates reflection brightness of the display from an output of the illuminance sensor 1 installed on the front surface of the display; a switching unit 4 which selects the illuminance sensors 1 and 2 installed on the front surface and the rear surface of the display as a main sensor and a sub-sensor, respectively; a brightness main reference table 5*a*, a brightness sub-reference table 5*b*, a black level main reference table 6*a*, a black level sub-reference table 6*b*, a saturation main reference table 7*a* and a saturation sub-reference table 7*b* which are tables for determining correction coefficients of respective correction parameters from output results of the main sensor and the sub-sensor; an average picture luminance (APL) measuring unit 8 which determines an average picture luminance gradation level of display images; a light environment APL reference table 9*a* and a dark environment APL reference table 9*b* which are tables for determining correction parameters of the brightness of the display from the determined average picture luminance gradation level; a selection unit 10 which selects those tables from conditions of an environment; and a control unit 101 (brightness control unit, black level control unit and saturation control unit) as a first control unit which corrects and controls parameters of brightness, black level and saturation using the respective correction parameters obtained from the respective tables. The brightness control unit includes brightness calculating units 11, 14 and 15, the black level control unit includes black level calculating units 12 and 16, and the saturation control unit includes saturation calculating units 13 and 17. Note that this configuration is merely an example, and at least the illuminance sensor 2 is required to be included in the display device of the present invention.

In FIG. 1, a sensor section 1*a* and a conversion section 1*b* included in the illuminance sensor 1 and the APL measuring unit 8 are typically implemented in hardware, which is similar in the illuminance sensor 2. Other components are implemented by a software processing of a control computer. In FIG. 1, the illuminance sensor 1 is provided on the front surface (display) of the display device, and includes the conversion section 1*b* (calculation expression or table) which converts a physical measurement value of the sensor section 1*a* into an illuminance value. The calculating unit 3 calculates reflection brightness of reflected light on the display surface of the display by incident light entering the display surface, which has been measured by the illuminance sensor 1 on the front surface, from illuminance of the incident light. The calculating unit 3 can be implemented in software or be bypassed (not used).

The illuminance sensor 2 is installed on the rear surface of the display, and as in the case of the illuminance sensor 1, includes a conversion section 2*b* (calculation expression or table) which converts a physical measurement value of a sensor section 2*a* into an illuminance value.

The switching unit 4 as a second switching unit is provided for switching a destination to which measurement results of the sensors 1 and 2 on the front and rear surfaces, respectively, are applied and for turning off a measurement function.

The brightness main reference table 5*a* and the brightness sub-reference table 5*b* are provided for referring to a correction coefficient of backlight brightness from the brightness or illuminance value on the front surface or the rear surface, and a correspondence between the brightness main reference table 5*a* and the illuminance sensors 1 and 2 and a correspondence between the brightness sub-reference table 5*b* and the illuminance sensors 1 and 2 vary in accordance with a state of operation setting.

The black level main reference table 6*a* and the black level sub-reference table 6*b* are provided for referring to a correction coefficient of a black level of a display from the brightness or illuminance value of the front surface or the rear surface, and a correspondence between the black level main reference table 6*a* and the illuminance sensors 1 and 2 and a correspondence between the black level sub-reference table 6*b* and the illuminance sensors 1 and 2 vary in accordance with the state of the operation setting.

The saturation main reference table 7*a* and the saturation sub-reference table 7*b* are provided for referring to a correction coefficient of saturation of a display from the brightness or illuminance value of the front surface or the rear surface, and a correspondence between the saturation main reference table 7*a* and the illuminance sensors 1 and 2 and a correspondence between the saturation main reference table 7*b* and the illuminance sensors 1 and 2 vary in accordance with the state of the operation setting.

The brightness calculating unit 11 is provided for performing weighted addition on the backlight brightness correction coefficients determined by the brightness main reference table 5*a* and the brightness sub-reference table 5*b* to determine a backlight brightness correction value.

The black level calculating unit 12 is provided for performing weighted addition on the black level correction coefficients determined by the black level main reference table 6*a* and the black level sub-reference table 6*b* to determine a black level correction value.

The saturation calculating unit 13 is provided for performing weighted addition on the saturation correction coefficients determined by the saturation main reference table 7*a* and the saturation sub-reference table 7*b* to obtain a saturation correction value.

The APL measuring unit 8 is provided for measuring the average picture luminance (APL) gradation level of display image data to be input to the display device. The light environment APL reference table 9*a* and the dark environment APL reference table 9*b* are reference tables or calculation expressions for determining a backlight brightness correction parameter based on the measurement result of the APL measuring unit 8, and a plurality thereof are provided in the display device. The selection unit 10 selects any of a plurality of reference tables 9*a* and 9*b* or invalidates the unit itself. The brightness calculating unit 14 is provided for multiplying an output of the selection unit 10 and an output of the brightness calculating unit 11 together to determine the backlight brightness correction value.

The brightness calculating unit 15 is provided for determining the backlight brightness correction value from an output of the brightness calculating unit 14 and a backlight control parameter for user adjustment.

The black calculating unit 16 is provided for determining the black level correction value from an output of the black level calculating unit 12 and a black level control parameter for user adjustment.

The saturation calculating unit 17 is provided for determining a saturation correction value from an output of the saturation calculating unit 13 and a saturation control parameter for user adjustment.

Figure 2:
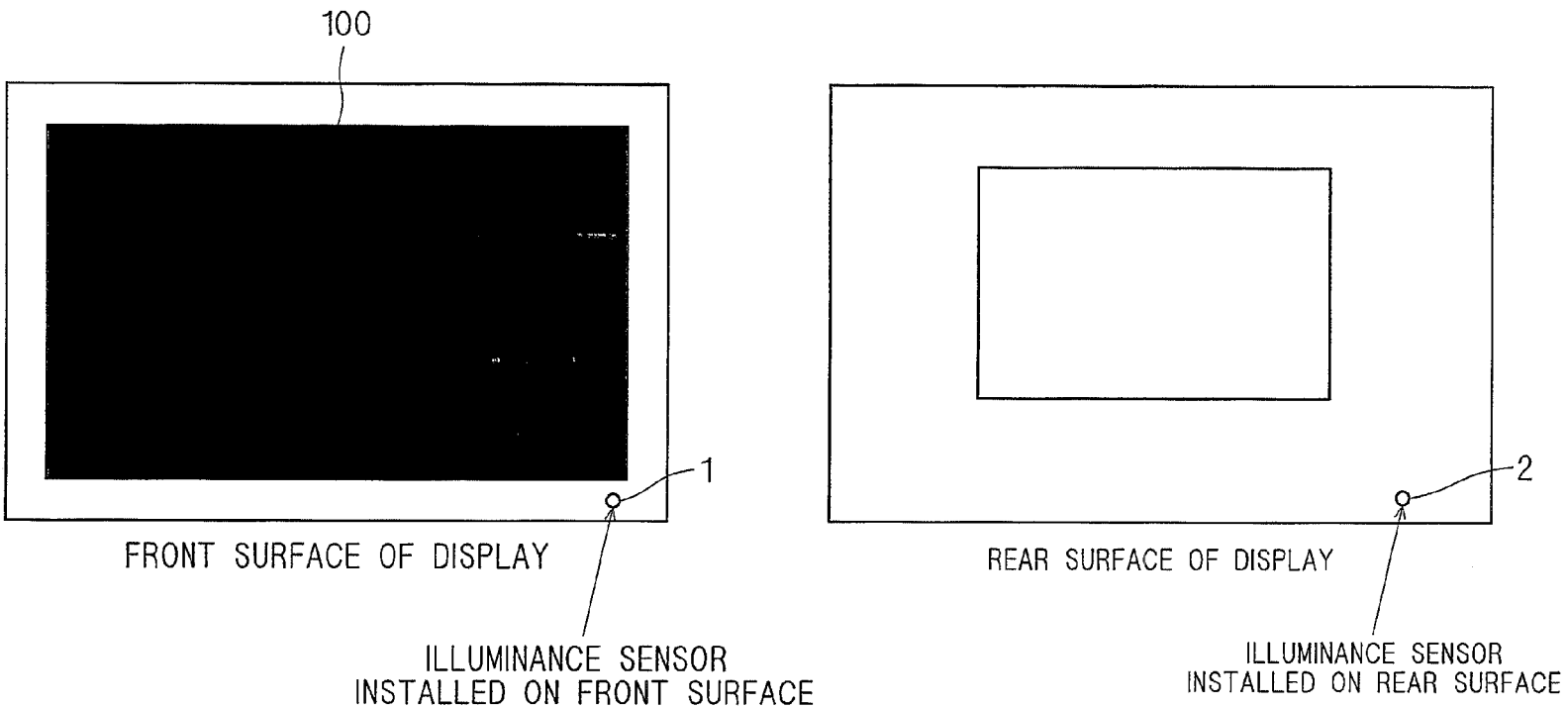
FIG. 2 is a diagram showing setting positions of illuminance sensors according to the first preferred embodiment of the present invention.

FIG. 2 is a diagram showing installation positions of the illuminance sensors according to preferred embodiments of the present invention. In the first preferred embodiment, the illuminance sensors 1 and 2 shown in FIG. 1 are attached to the front surface (side on which the display surface is provided) and the rear surface of, for example, a display 100 as shown in FIG. 2, respectively.

Figure 3:
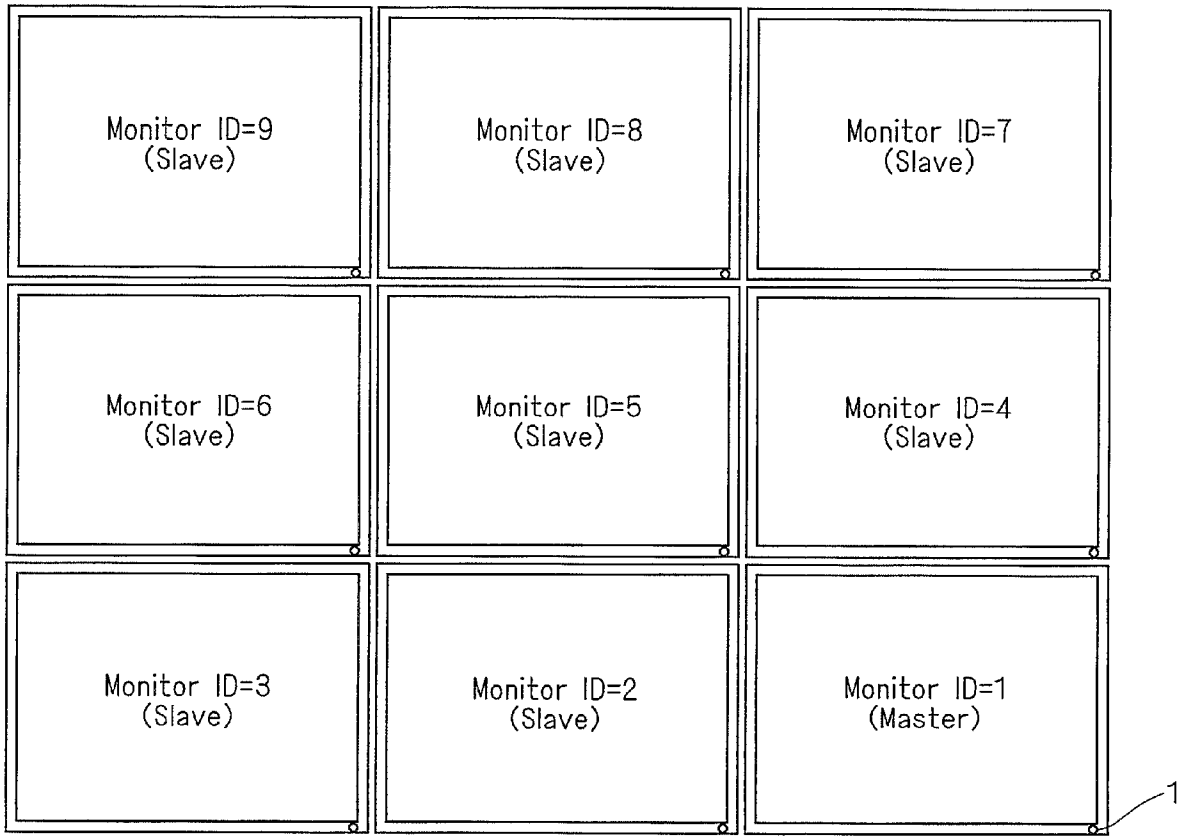
FIG. 3 is a diagram showing an installation example of a multi-monitor according to the first preferred embodiment of the present invention.

FIG. 3 shows an installation example when a multi-monitor is connected in this preferred embodiment. In FIG. 3, nine display devices are combined to form one large screen. Each of the display devices has an individual ID, and IDs (values) different from each other are set in advance by an on-screen display (OSD) function or the like provided in the display devices.

Figure 4:
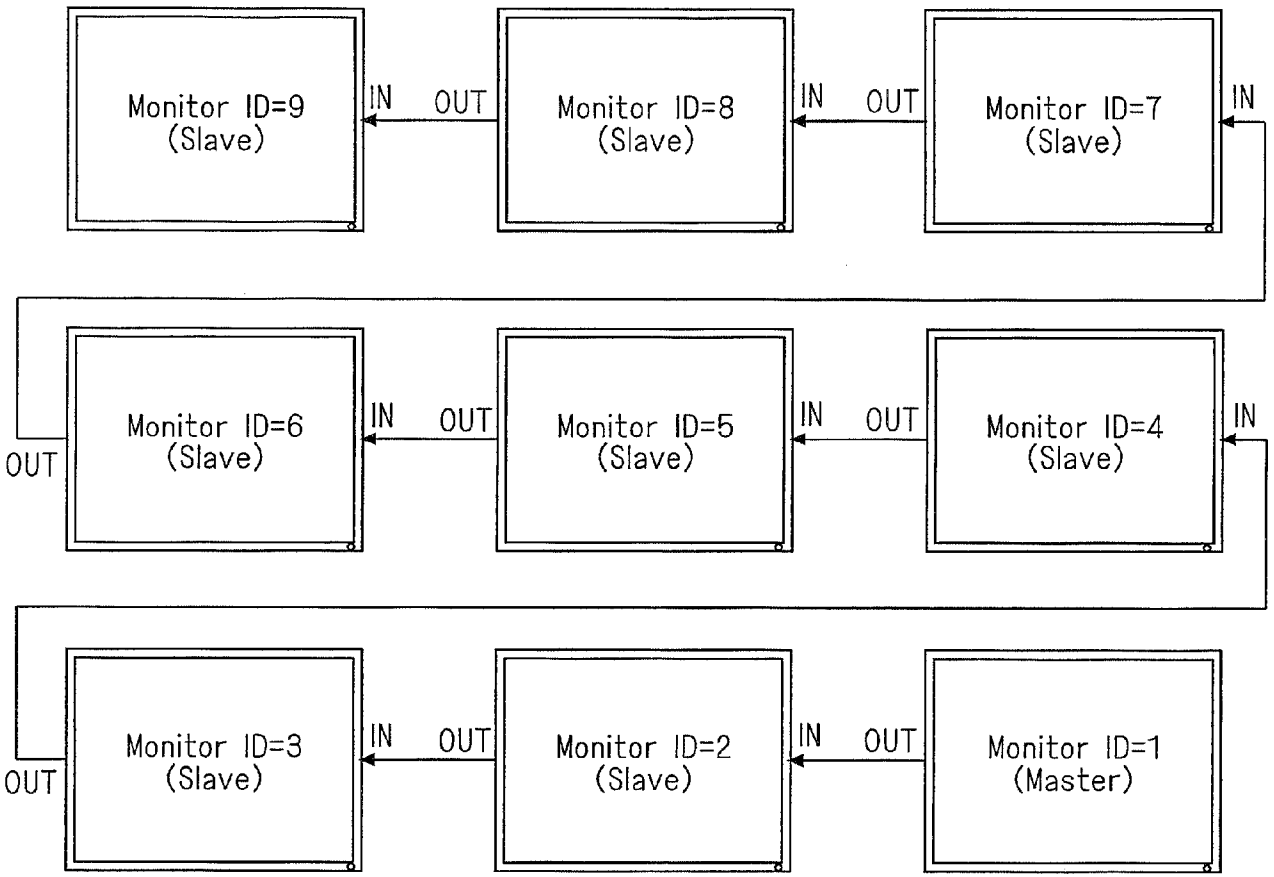
FIG. 4 is a diagram showing an example of communication line connection when the multi-monitor according to the first preferred embodiment of the present invention is installed.

FIG. 4 shows a connection method for a communication unit with the configuration of FIG. 3, in which input/output terminals thereof are connected to each other in a daisy chain manner by a communication unit such as an RS232 and a USB.

(A-2. Operation)

(A-2-1. Operation of Display Device)

Next, an operation of the display device according to the first preferred embodiment will be described.

Figure 6:
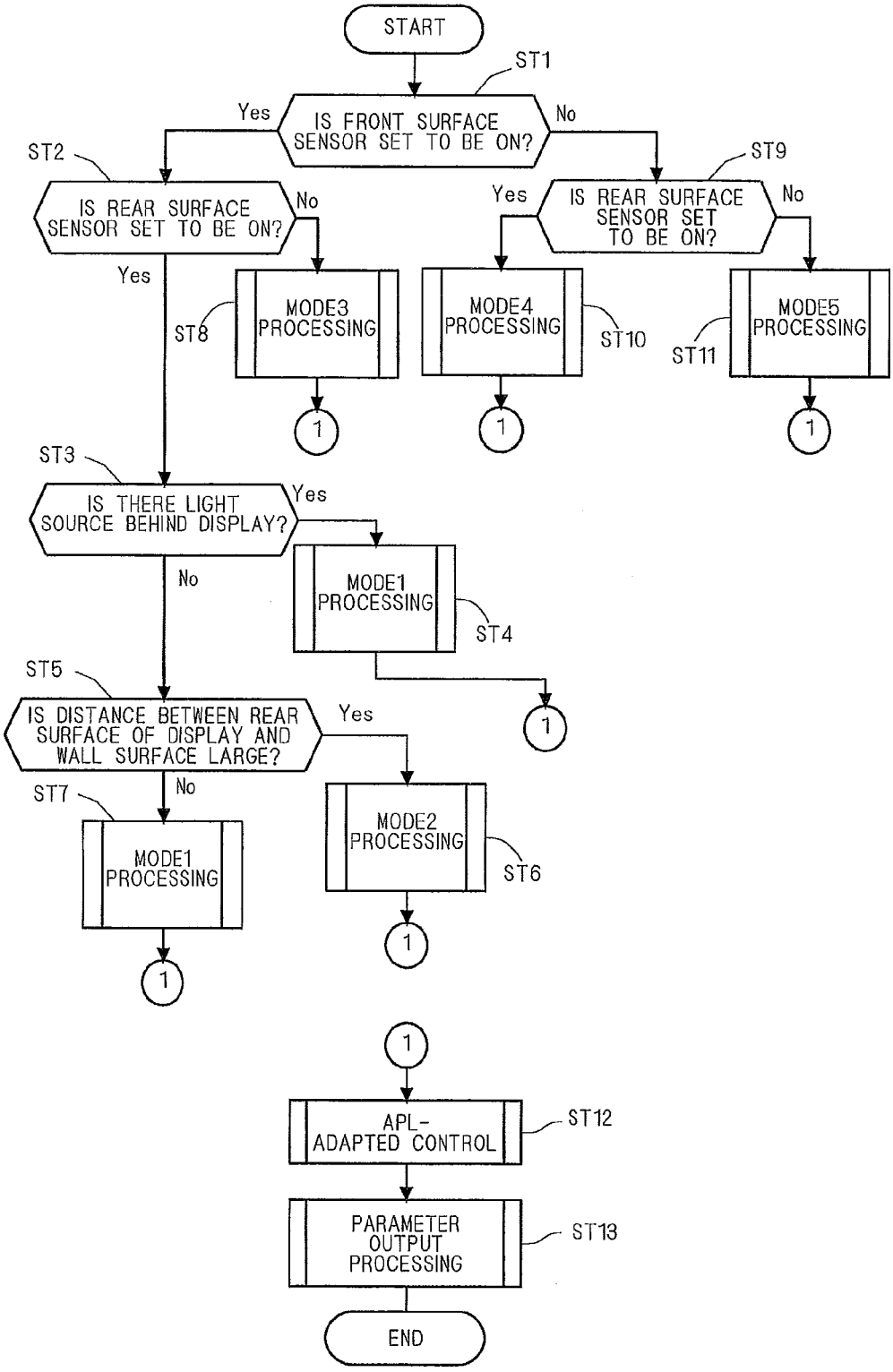
FIG. 6 is a flowchart showing an entire operation of an outside light correction processing according to the first preferred embodiment of the present invention.

FIG. 6 is a flowchart showing the operation of the display device according to the first preferred embodiment of the present invention. The operation thereof will be described below with reference to FIG. 6. This operation is implemented in firmware of a microcontroller incorporated in the display device.

Figure 5:
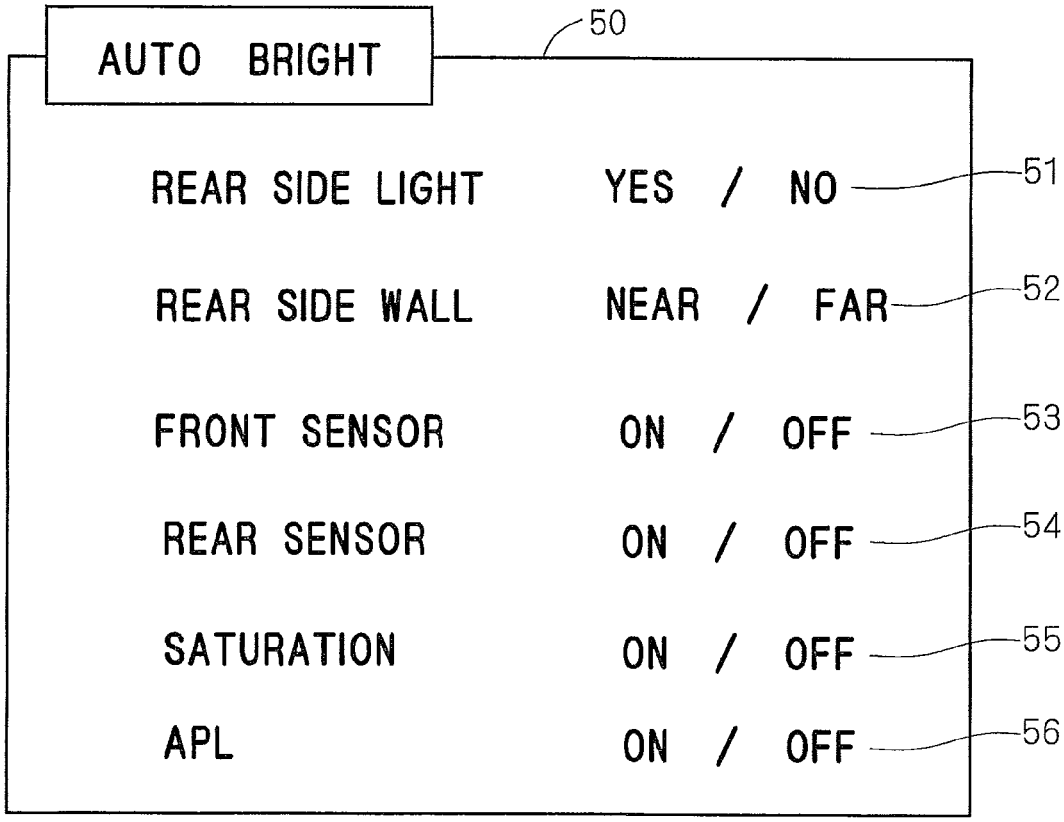
FIG. 5 is a diagram showing an example of an OSD menu for outside light correcting operation parameter setting according to the first preferred embodiment of the present invention.

When, for example, the display device is installed, the user uses an OSD menu 50 as shown in FIG. 5 to set in advance ON/OFF setting of the sensors installed on the front surface and the rear surface (in FIG. 5, ON/OFF switching 53 of the illuminance sensor 1 on the front surface and ON/OFF switching 54 of the illuminance sensor 2 on the rear surface which serve as first switching unit), whether there is a light source such as lighting or outside light (such as lighting appliance or window) behind the display (in FIG. 5, outside light setting 51 as a setting unit), a distance between the display and a wall surface (for example, whether or not the distance between the display and the wall surface therebehind is three times or more the size of the display device; in FIG. 5, distance setting 52 as a setting unit), presence/absence of saturation correction (ON/OFF switching 55 of saturation correction), and switching of APL correction (APL switching 56).

In this operation, the operations in processing modes (MODE1 to MODE5 of FIG. 6) are switched in accordance with the above-mentioned setting contents.

First, ON/OFF setting of the front surface sensor, which has been set in the ON/OFF switching 53 of the illuminance sensor 1 on the front surface, is checked (Step ST1). The process proceeds to Step ST2 if the front surface sensor is ON. Meanwhile, if the front surface sensor is OFF, the process proceeds to Step ST9 and ON/OFF setting of the illuminance sensor 2 on the rear surface, which has been set in the ON/OFF switching 54, is checked. If it is determined in Step ST2 that the rear surface sensor is OFF, the process proceeds to Step ST8, and an operation mode is set as MODE3, and a processing in MODE3 is performed. If it is determined in Step ST2 that the rear surface sensor is ON, the presence/absence of the light source behind the display device is checked in the outside light setting 51 in Step ST3, and if there is the light source behind the display, the process proceeds to Step ST4, and a processing in MODE1 is performed. If it is determined in Step ST3 that there is no light source behind the display device, the process proceeds to Step ST5, and the distance setting between the rear surface of the display and the wall surface, which has been set in the distance setting 52, is determined. If the distance is large, the process proceeds to Step ST6, and a processing in MODE2 is performed, while if the distance is small, the process proceeds to Step ST7, and the processing in MODE1 is performed.

If it is determined in Step ST9 that the rear surface sensor is ON, the process proceeds to Step ST10, and a processing in MODE4 is performed. On the other hand, if it is determined that the rear surface sensor is OFF, the process proceeds to Step ST11, and a processing in MODE5 is performed.

If the respective processings in MODE1 to MODE5 are finished, the process proceeds to Step ST12, and a brightness correction processing is performed in accordance with an input APL gradation level of an image. Then, in Step ST13, an output processing for setting brightness and black level and saturation control, which is in accordance with the respective correction parameters determined in the above-mentioned processing, is performed.

(A-2-2. Operations in Respective Processings)

The contents of the respective processings (in MODE1 to MODE5) will be described below.

Figure 7:
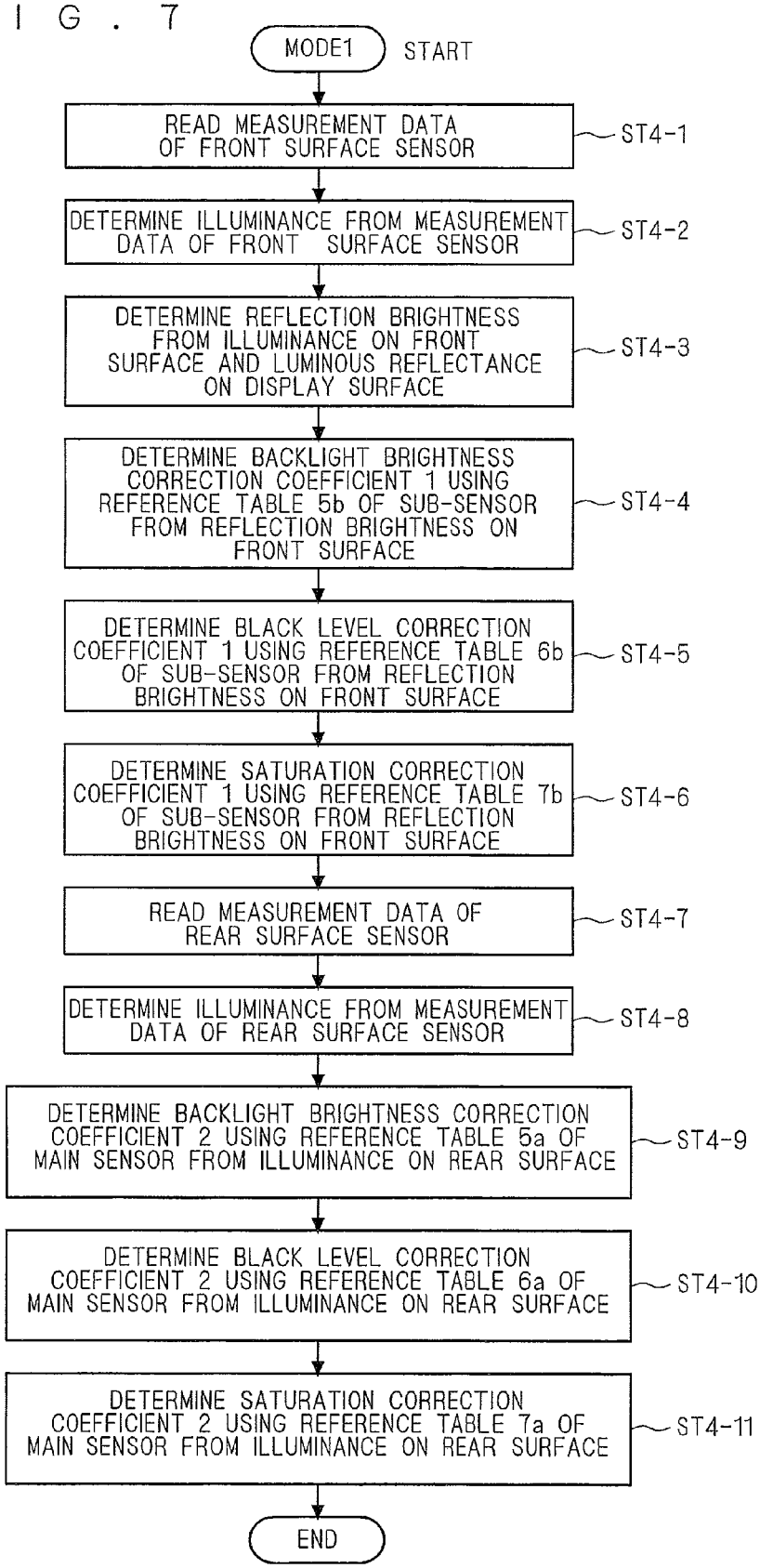
FIG. 7 is a flowchart showing an operation in an operation mode 1 of the outside light correction processing according to the first preferred embodiment of the present invention.

FIG. 7 is a flowchart showing the operation in MODE1 In FIG. 7, first, measurement data of the illuminance sensor 1 on the front surface is read (Step ST4-1). Next, illuminance is determined from the measurement data of the illuminance sensor 1 on the front surface (Step ST4-2).

In this case, a measurement value of the illuminance sensor 1 on the front surface is multiplied by a certain coefficient in which a gain or the like of an optical system or a detection (amplifier) circuit is taken into consideration, and the resultant is made an illuminance value.

Next, reflection brightness on the display surface of the display is determined using the illuminance value obtained in Step ST4-2 and a luminous reflectance on the display surface of the display (Step ST4-3).

For example, in a case where it is assumed that the display surface of the display is a perfect diffusion surface (by non-glare treatment or the like) and that the luminous reflectance on the display surface is 5%, reflection brightness is approximated so that, for example, (reflectance brightness)=(measurement illuminance)/$\pi\times0.05$ (for example, approximately 5 cd/m$^2$ in a case of illuminance of 300 lux). In an actual operation, calculation is made by multiplying the above-mentioned expression by a certain correction coefficient.

Next, the process proceeds to Step ST4-4, and a backlight brightness correction coefficient 1 is determined using the brightness sub-reference table 5*b* in a case where the front surface is a sub-surface from the reflection brightness determined in Step ST4-3. In the same manner, a black level correction coefficient 1 is determined using the black level sub-reference table 6*b* in the case where the front surface is the sub-surface (Step ST4-5). In addition, a saturation correction coefficient 1 is determined using the saturation sub-reference table 7*b* in the case where the front surface is the sub-surface (Step ST4-6).

Next, the process proceeds to Step ST4-7, and measurement data of the illuminance sensor 2 on the rear surface is read. Then, in Step ST4-8, a measurement value is multiplied by a certain coefficient in which a gain or the like of an optical system or a detection (amplifier) circuit is taken into consideration, and the resultant is made an illuminance value.

Next, a backlight brightness correction coefficient 2 is determined using the brightness main reference table 5*a* in a case where the rear surface is a main surface from the illuminance determined in Step ST4-8 (Step ST4-9). In the same manner, a black level correction coefficient 2 is determined using the black level main reference table 6*a* in the case where the rear surface is the main surface (Step ST4-10). In addition, a saturation correction coefficient 2 is determined using the saturation main reference table 7*a* in the case where the rear surface is the main surface (Step ST4-11).

The processing in MODE1 is finished in this manner, and the process proceeds to Step ST12.

Figure 8:
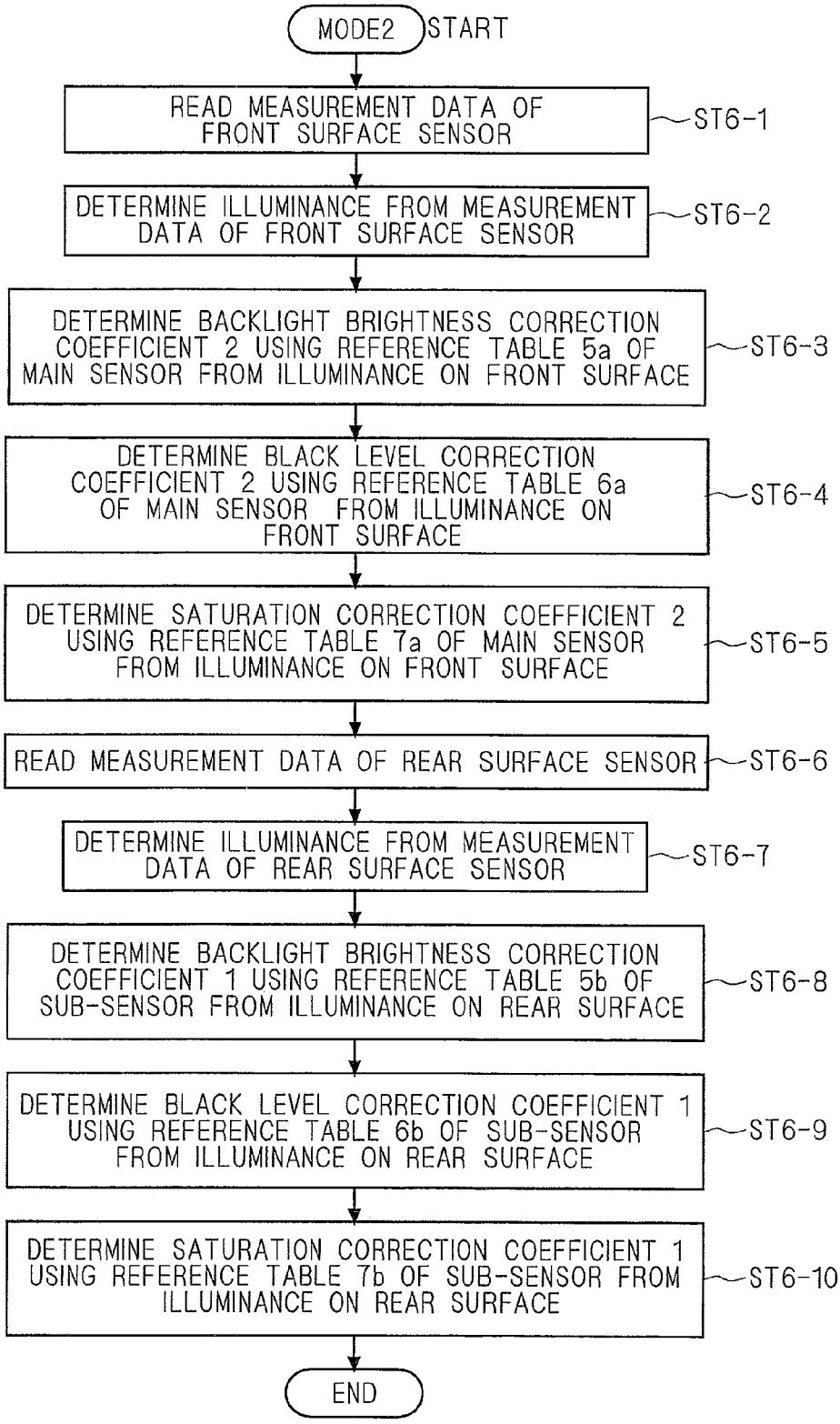
FIG. 8 is a flowchart showing an operation in an operation mode 2 of the outside light correction processing according to the first preferred embodiment of the present invention.

FIG. 8 is a flowchart showing the operation in MODE2. In FIG. 8, first, the measurement data of the illuminance sensor 1 on the front surface is read (Step ST6-1). Next, illuminance is determined from the measurement data of the illuminance sensor 1 on the front surface (Step ST6-2).

In this case, the measurement value of the illuminance sensor 1 on the front surface is multiplied by a certain coefficient in which a gain or the like of an optical system or a detection (amplifier) circuit is taken into consideration, and the resultant is made an illuminance value.

Next, the process proceeds to Step ST6-3, and the backlight brightness correction coefficient 2 is determined using the brightness main reference table 5*a* in the case where the front surface is the main surface from the illuminance determined in Step ST6-2. In the same manner, the black level correction coefficient 2 is determined using the black level main reference table 6*a* in the case where the front surface is the main surface (Step ST6-4). In addition, the saturation correction coefficient 2 is determined using the saturation main reference table 7*a* in the case where the front surface is the main surface (Step ST6-5).

Next, the process proceeds to Step ST6-6, and measurement data of the illuminance sensor 2 on the rear surface is read. Then, in Step ST6-7, the measurement value is multiplied by a certain coefficient in which a gain or the like of an optical system or a detection (amplifier) circuit is taken into consideration, and the resultant is made an illuminance value.

Next, the backlight brightness correction coefficient 1 is determined using the brightness sub-reference table 5*b* in the case where the rear surface is the sub-surface from the illuminance determined in Step ST6-7 (Step ST6-8). In the same manner, the black level correction coefficient 1 is determined using the black level sub-reference table 6*b* in the case where the rear surface is the sub-surface (Step ST6-9). In addition, the saturation correction coefficient 1 is determined using the saturation sub-reference table 7*b* in the case where the rear surface is the sub-surface (Step ST6-10).

The processing in MODE2 is finished in this manner, and the process proceeds to Step ST12.

Figure 9:
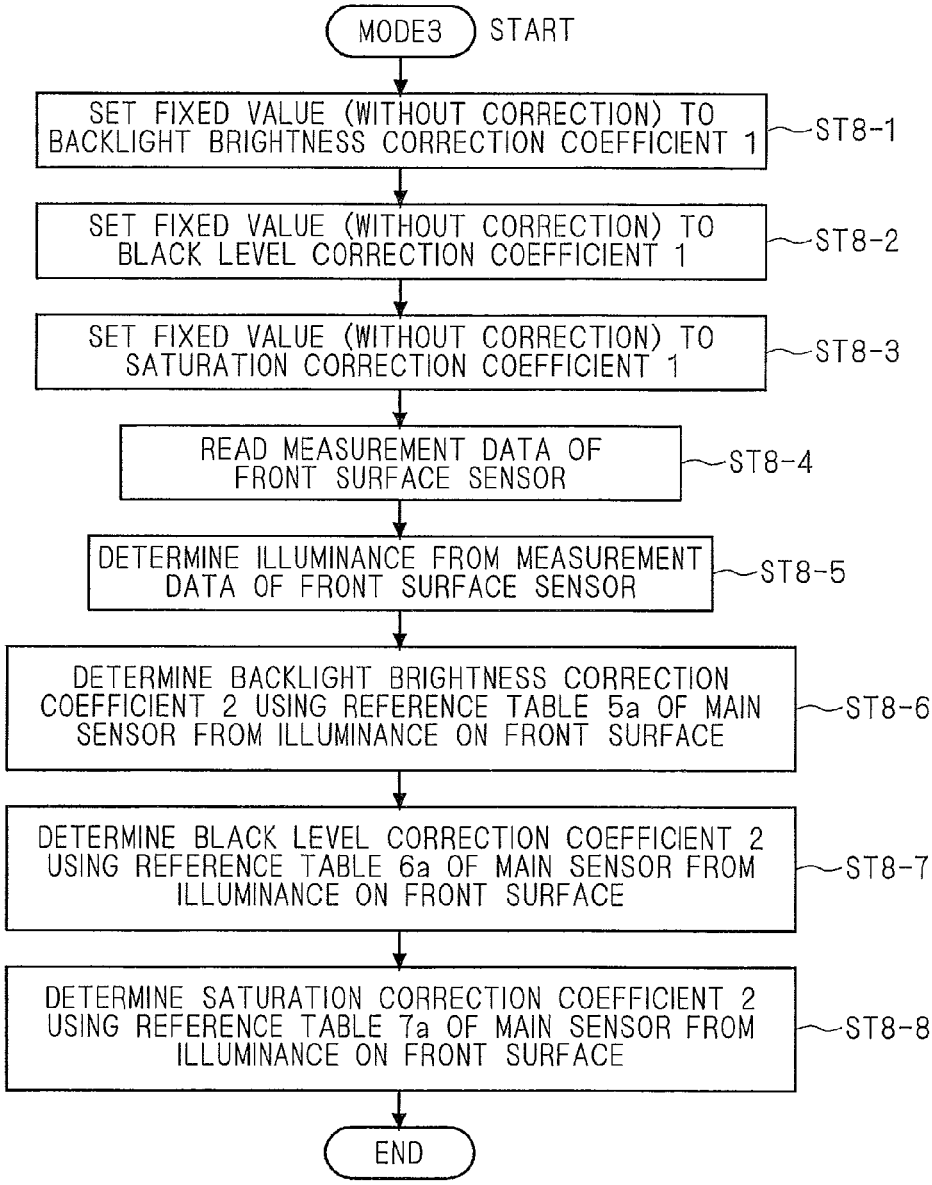
FIG. 9 is a flowchart showing an operation in an operation mode 3 of the outside light correction processing according to the first preferred embodiment of the present invention.

FIG. 9 is a flowchart showing the operation in MODE3.

In this case, the illuminance sensor 2 on the rear surface is OFF, and thus fixed values are respectively set so that the parameters to be controlled by the illuminance sensor 2 on the rear surface are not corrected.

First, the fixed value is set to the backlight brightness correction coefficient 1 in Step ST8-1, and then the fixed value is set to the black level correction coefficient 1 in Step ST8-2. Next, the fixed value is set to the saturation correction coefficient 1 in Step ST8-3.

Next, the process proceeds to Step ST8-4, and the measurement data of the illuminance sensor 1 on the front surface is read. Then, in Step ST8-5, the measurement value is multiplied by a certain coefficient in which a gain or the like of an optical system or a detection (amplifier) circuit is taken into consideration, and the resultant is made an illuminance value.

Next, the backlight brightness correction coefficient 2 is determined using the brightness main reference table 5*a* in the case where the front surface is the main surface from the illuminance determined in Step ST8-5 (Step ST8-6). In the same manner, the black level correction coefficient 2 is determined using the black level main reference table 6*a* in the case where the front surface is the main surface (Step ST8-7).

Then, the saturation correction coefficient 2 is determined using the saturation main reference table 7*a* in the case where the front surface is the main surface (Step ST8-8).

The processing in MODE3 is finished in this manner, and the process proceeds to Step ST12.

Figure 10:
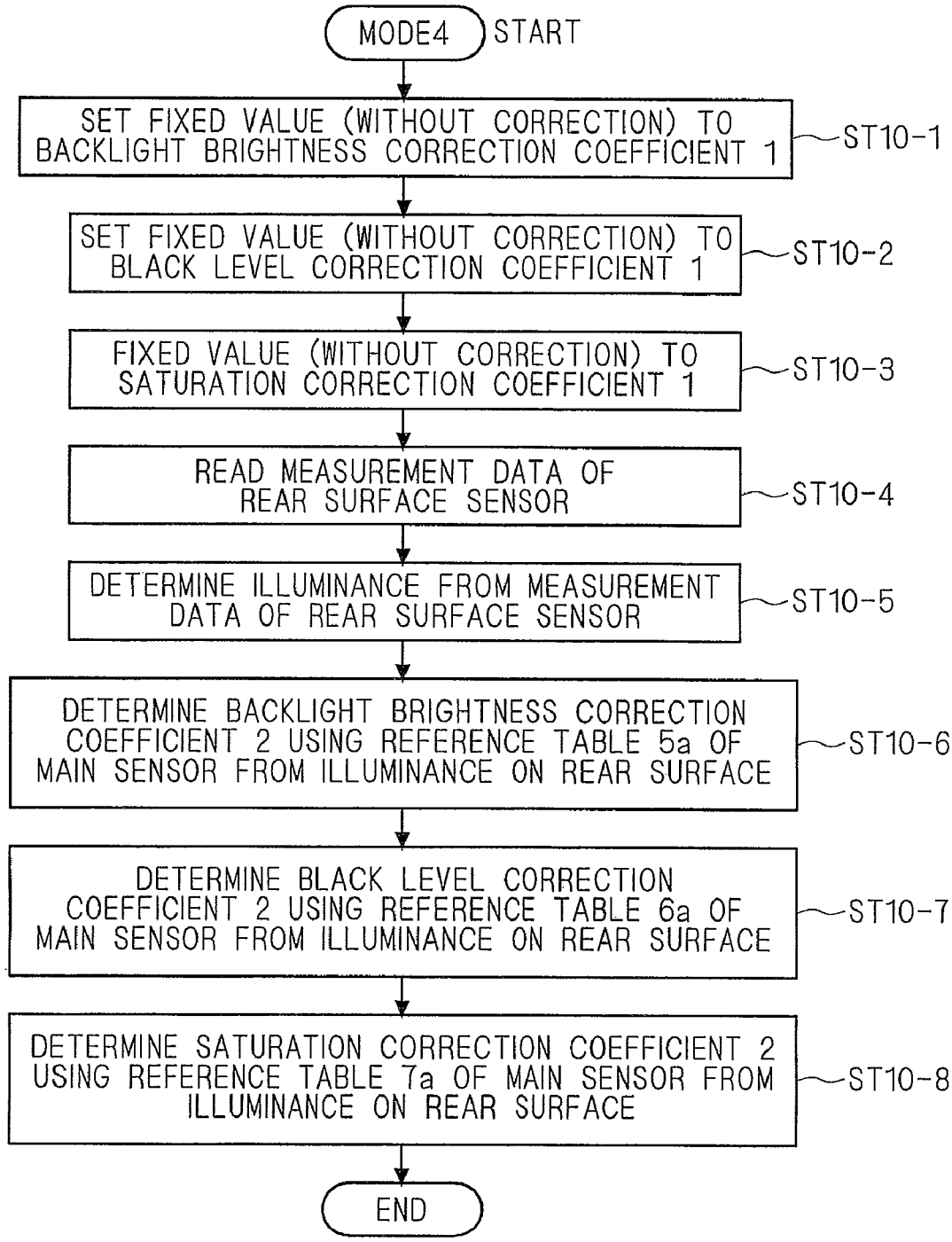
FIG. 10 is a flowchart showing an operation in an operation mode 4 of the outside light correction processing according to the first preferred embodiment of the present invention.

FIG. 10 is a flowchart showing the operation in MODE4.

In this case, the illuminance sensor 1 on the front surface is OFF, and thus fixed values are set so that the parameters to be controlled by the illuminance sensor 1 on the front surface are not corrected.

First, the fixed value is set to the backlight brightness correction coefficient 1 in Step ST10-1, and then the fixed value is set to the black level correction coefficient 1 in Step ST10-2. Next, the fixed value is set to the saturation correction coefficient 1 in Step ST10-3.

Next, the process proceeds to Step ST10-4, and the measurement data of the illuminance sensor 2 on the rear surface is read. Then, in Step ST10-5, the measurement value is multiplied by a certain coefficient in which a gain or the like of an optical system or a detection (amplifier) circuit is taken into consideration, and the resultant is made an illuminance value.

Next, the backlight brightness correction coefficient 2 is determined using the brightness main reference table 5*a* in the case where the rear surface is the main surface from the illuminance determined in Step ST10-5 (Step ST10-6). In the same manner, the black level correction coefficient 2 is determined using the black level main reference table 6*a* in the case where the rear surface is the main surface (Step ST10-7). Then, the saturation correction coefficient 2 is determined using the saturation main reference table 7*a* in the case where the rear surface is the main surface (Step ST10-8).

The processing in MODE4 is finished in this manner, and the process proceeds to Step ST12.

Figure 11:
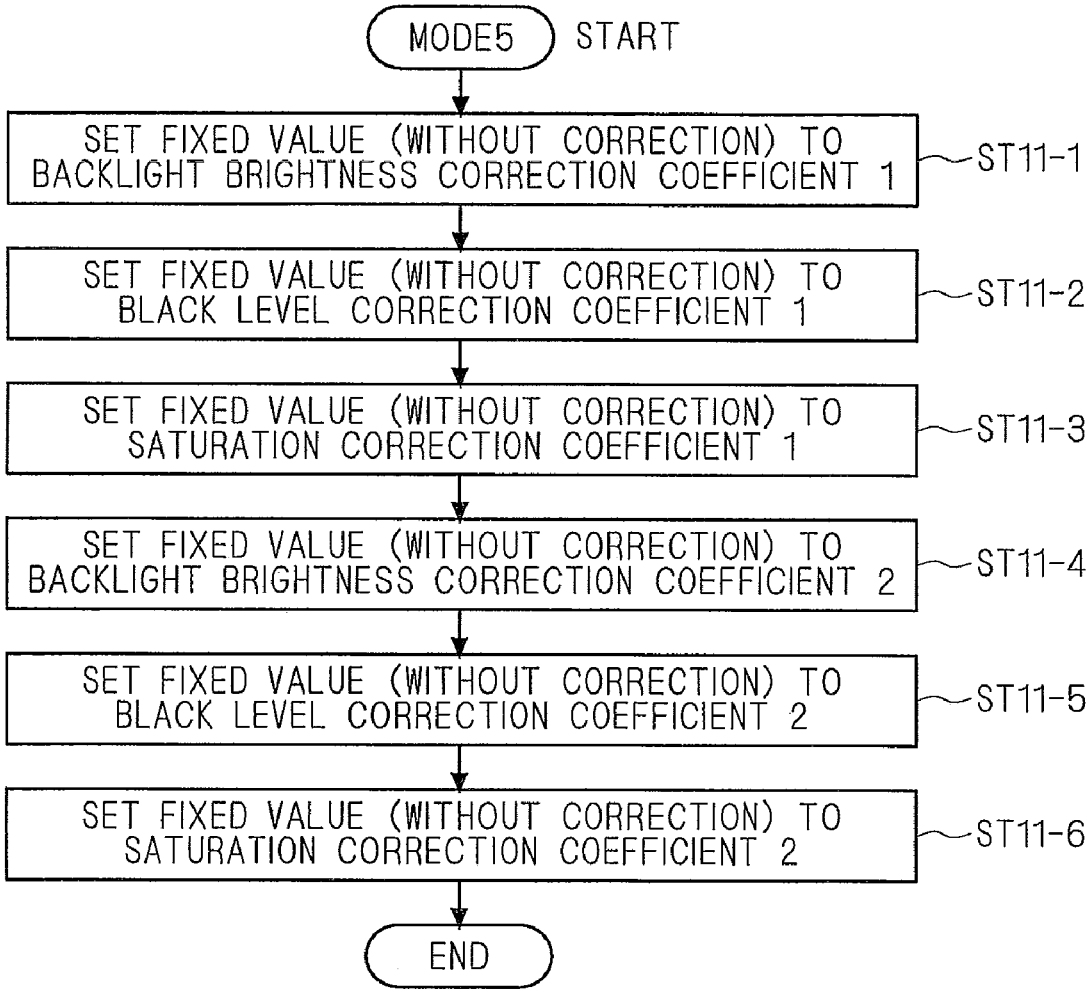
FIG. 11 is a flowchart showing an operation in an operation mode 5 of the outside light correction processing according to the first preferred embodiment of the present invention.

FIG. 11 is a flowchart showing the operation in MODE5.

In this case, the illuminance sensor 1 on the front surface and the illuminance sensor 2 on the rear surface are both OFF, and thus fixed values are set so that the parameters to be controlled by the both sensors are not corrected.

First, the fixed value is set to the backlight brightness correction coefficient 1 in Step ST11-1, and then the fixed value is set to the black level correction coefficient 1 in Step ST11-2. Next, the fixed value is set to the saturation correction coefficient 1 in Step ST11-3.

Next, the fixed value is set to the backlight brightness correction coefficient 2 in Step ST11-4, and then the fixed value is set to the black level correction coefficient 2 in Step ST11-5. Next, the fixed value is set to the saturation correction coefficient 2 in Step ST11-6.

The processing in MODE5 is finished in this manner, and the process proceeds to Step ST12.

Figure 12:
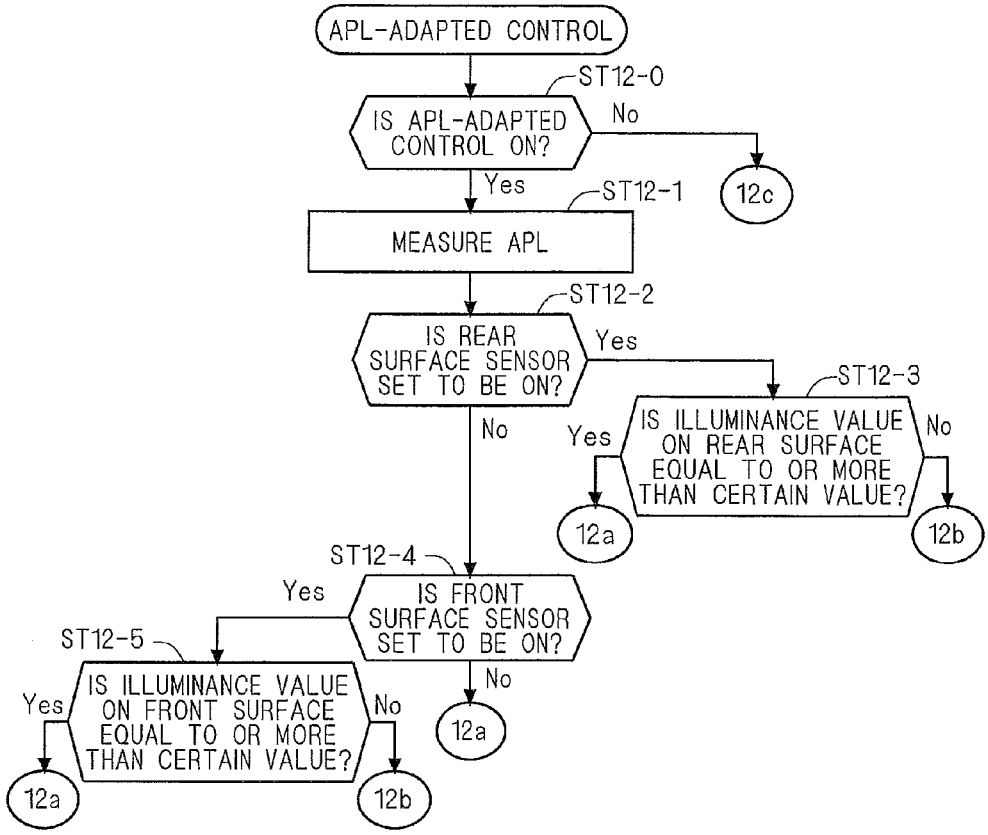
FIG. 12 is a flowchart showing an operation of an APL-adapted brightness correction processing according to the first preferred embodiment of the present invention.
Figure 13:
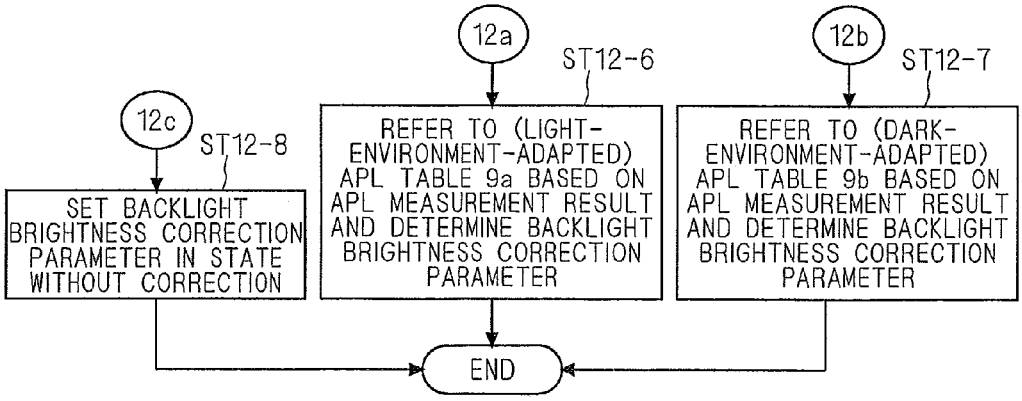
FIG. 13 is another flowchart showing the operation of the APL-adapted brightness correction processing according to the first preferred embodiment of the present invention.

FIG. 12 and FIG. 13 are flowcharts showing an operation of performing backlight control in accordance with an APL gradation level of image data. Here, in accordance with an illuminance environment under which the display device is installed, switching is made between a light environment APL reference table 9*a* and a dark environment APL reference table 9*b* which are APL-adapted brightness correction parameter reference tables.

In FIG. 12, if the APL control, which has been set in the APL switching 56 of FIG. 5, is set to be OFF in ON/OFF setting of APL control, the process proceeds to Step ST12-8, and there is set a backlight brightness correction parameter in which the brightness correction by the APL is not performed.

If the APL control is set to be ON in the ON/OFF setting of APL control, an APL is measured in Step ST12-1.

Then, ON/OFF setting of the illuminance sensor 2 on the rear surface, which has been set in the ON/OFF switching 54, is referred to (Step ST12-2). The process proceeds to Step ST12-3 if the rear surface sensor is ON, and in a case where an illuminance value on the rear surface is equal to or more than a certain value, it is determined that the setting environment of the display device is the light environment, whereby the process proceeds to Step ST12-6. Meanwhile, in a case where the illuminance value on the rear surface is less than the certain value, it is determined that the setting environment of the display device is the dark environment, whereby the process proceeds to Step ST12-7.

If the rear surface sensor is OFF in Step ST12-2, the process proceeds to Step ST12-4, and the ON/OFF setting of the front surface sensor, which has been set in the ON/OFF switching 53 of the illuminance sensor 1 on the front surface of FIG. 5, is referred to. The process proceeds to Step ST12-5 if the front surface sensor is ON, and in a case where the illuminance value on the front surface is equal to or more than a certain value, it is determined that the setting environment of the display device is the light environment, whereby the process proceeds to Step ST12-6. Meanwhile, in a case where the illuminance value on the front surface is less than the certain value, it is determined that the setting environment of the display device is the dark environment, whereby the process proceeds to Step ST12-7.

In Step ST12-6, which is adapted to the light environment, the light environment APL reference table 9*a* is referred to based on the measurement result of the APL, to thereby determine the backlight brightness parameter.

In Step ST12-7, which is adapted to the dark environment, the dark environment APL reference table 9*b* is referred to based on the measurement result of the APL, to thereby determine the backlight brightness parameter.

The backlight brightness correction processing by the APL is finished as described above, and the process proceeds to Step ST13.

Figure 14:
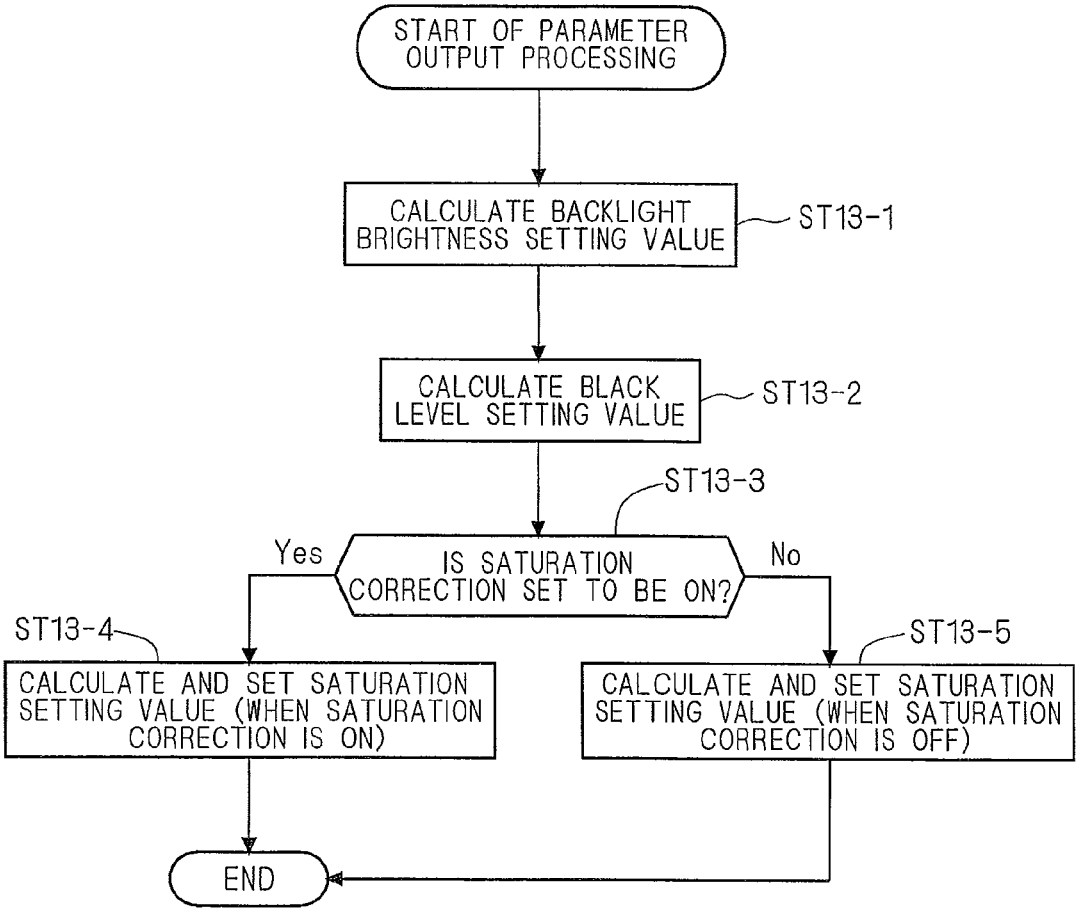
FIG. 14 is a flowchart showing an operation of an image quality control parameter output control processing according to the first preferred embodiment of the present invention.

FIG. 14 is a flowchart showing a parameter output processing of Step ST13.

In Step ST13-1, a value to be set as a backlight brightness correction value is calculated from a calculation expression below, and a result thereof is set as an output of the brightness control unit.

$$\text{BRIGHTNESS}=(K1\times BL_COR1+K2\times BL_COR2)\times APL_CON\times \text{USER_BRIGHTNESS}$$

Here, BRIGHTNESS represents the backlight brightness correction value (value of 0 to 255), BL_COR1 represents the backlight correction coefficient 1, BL_COR2 represents the backlight correction coefficient 2, APL_CON represents the backlight control parameter by APL, USER_BRIGHTNESS represents the backlight control parameter for user adjustment, and K1 and K2 represent a constant.

In Step ST13-2, a value to be set as the black level correction value is calculated from a calculation expression below, and a result thereof is set as an output of the black level control unit.

$$BLK_\text{LEVEL}=(L1\times BLK_COR1+L2\times BLK_COR2)+\text{USER}_BLK_\text{LEVEL}$$

Here, BLK_LEVEL represents the black level correction value (value of 0 to 255), BLK_COR1 represents the black level correction coefficient 1, BLK_COR2 represents the black level correction coefficient 2, USER_BLK_LEVEL represents the black level control parameter for user adjustment, and L1 and L2 represent a constant.

Next, in Step ST13-3, the ON/OFF setting content of saturation correction, which has been set in the ON/OFF switching 55 for saturation correction of FIG. 5, is referred to. Then, the process proceeds to Step ST13-4 if the saturation correction is ON, and a value to be set as a saturation correction value is calculated from a calculation expression below, whereby a result thereof is set as an output of the saturation control unit.

$$SATURATION=(M1\times SAT_COR1+M2\times SAT_COR2)+USER_SATURATION$$

Here, SATURATION represents the saturation correction value (value of 0 to 255), SAT_COR1 represents the saturation correction coefficient 1, SAT_COR2 represents the saturation correction coefficient 2, USER_SATURATION represents the saturation control parameter for user adjustment, and M1 and M2 represent a constant.

The process proceeds to Step ST13-5 if the saturation correction is OFF in Step ST13-3, and a saturation correction value is calculated from a calculation expression below, whereby a result thereof is set as an output of the saturation control unit.

$$SATURATION=USER_SATURATION$$

Here, SATURATION represents the saturation correction value (value of 0 to 255), and USER_SATURATION represents the saturation control parameter for user adjustment.

(A-3. Effects)

According to the first preferred embodiment of the present invention, the display device includes the display 100 which is provided on the front surface of the display device and is the display surface on which the images are displayed, the illuminance sensor 2 which is provided on the rear surface of the display device and is the first measuring unit measuring illuminance on the rear surface, and the control unit 101 which is the first control unit performing brightness control on the images displayed on the display 100 in accordance with the measurement result of the illuminance sensor 2. Accordingly, incident light behind the display 100 is measured, and brightness control adapted to the incident light is performed, whereby it is possible to perform brightness control corresponding to an adaptation state of eyes of an observer.

Further, according to the first preferred embodiment of the present invention, the display device further includes the illuminance sensor 1 which is provided on the front surface of the display device and is the second measuring unit measuring illuminance on the front surface, and the brightness control unit performs brightness control on the images displayed on the display 100 in accordance with the measurement result of at least one of the illuminance sensors 1 and 2. In this manner, the illuminance sensors 1 and 2 are installed on the front surface and the rear surface of the display device, respectively, and screen brightness is controlled in consideration of the illuminance sensors 1 and 2, whereby brightness control adapted to the setting adapted the installment environment is performed. Accordingly, it is possible to realize brightness and image quality control adapted to an adaptation state of eyes of an observer.

Further, according to the first preferred embodiment of the present invention, in the display device, the black level control unit performs black level control on the images displayed on the display 100 in accordance with the measurement result of at least one of the illuminance sensors 1 and 2. Accordingly, it is possible to control screen brightness mainly by the illuminance sensor 2 installed on the rear surface of the illuminance sensors 1 and 2 installed on the front surface and the rear surface of the display device, respectively. In addition, it is possible to correct a black level and screen brightness in accordance with reflection brightness of the display 100 mainly by, for example, the illuminance sensor 1 installed on the front surface.

Further, according to the first preferred embodiment of the present invention, the display device further includes the APL measuring unit 8 which is the unit measuring an average picture luminance gradation level of the images, and the brightness calculating unit performs brightness control on the images displayed on the display 100 in accordance with the average picture luminance gradation level. Accordingly, it is possible to realize brightness and image quality control adapted to an adaptation state of eyes of an observer, in which an APL is taken into consideration as well.

Further, according to the first preferred embodiment of the present invention, the display device further includes the light environment APL reference table 9*a* and the dark environment APL reference table 9*b* which are the first and second reference tables used in setting of the backlight brightness correction parameter being a first control value corresponding to an average picture luminance gradation level, respectively. The light environment APL reference table 9*a* and the dark environment APL reference table 9*b* are selected in accordance with the measurement result of at least one of the illuminance sensors 1 and 2 which are the first and second measuring units. The brightness control unit of the control unit 101 being the first control unit performs brightness control on the images displayed on the display 100 being the display surface also in accordance with the backlight brightness correction parameter set in the selected light environment APL reference table 9*a* and dark environment APL reference table 9*b*. Accordingly, it is possible to realize brightness, saturation and image quality control adapted to various environments and an adaptation state of eyes of an observer.

Further, according to the first preferred embodiment of the present invention, in the display device, the saturation control unit of the control unit 101 being the first control unit performs saturation control on the images displayed on the display 100 in accordance with the measurement result of at least one of the illuminance sensors 1 and 2. Accordingly, it is possible to realize brightness, saturation and image quality control adapted to various environments and an adaptation state of eyes of an observer.

Further, according to the first preferred embodiment of the present invention, the display device further includes the brightness main reference table 5*a*, the black level main reference table 6*a* and the saturation main reference table 7*a* being the third reference table, and the brightness sub-reference table 5*b*, the black level sub-reference table 6*b* and the saturation sub-reference table 7*b* being the fourth reference table. The third table and the fourth table are used in setting of the backlight brightness correction coefficients 1 and 2, the black level correction coefficients 1 and 2 and the saturation correction coefficients 1 and 2 which are the second control value when at least any of the brightness control, black level control and saturation control is controlled. The illuminance sensors 1 and 2 are made to correspond to the reference tables 5*a*, 6*a* and 7*a* and the reference tables 5*b*, 6*b* and 7*b* in an exchangeable manner, and the control unit 101 being the first control unit controls at least any of brightness, black level and saturation by the backlight brightness correction coefficients 1 and 2, the black level correction coefficients 1 and 2 and the saturation correction coefficients 1 and 2 which are set in the reference tables 5*a*, 6*a* and 7*a* and the reference tables 5*b*, 6*b* and 7*b*. Accordingly, it is possible to realize brightness, saturation and image quality control adapted to various environments and an adaptation state of eyes of an observer.

Further, according to the first preferred embodiment of the present invention, the display device further includes the calculating unit 3 which calculates reflection brightness on the front surface from the measurement result of the illuminance sensor 2 which is the second measuring unit, and the control unit 101 which is the first control unit controls brightness, black level and saturation of the images displayed on the display 100 in accordance with the result of at least one of the illuminance sensor 1 and the calculating unit 3. Accordingly, it is possible to realize brightness, saturation and image quality control adapted to various environments and an adaptation state of eyes of an observer.

Further, according to the first preferred embodiment of the present invention, the display device further includes the ON/OFF switching 53 for the illuminance sensor 1 on the front surface and the ON/OFF switching 54 for the illuminance sensor 2 on the rear surface, which are the first switching unit switching between ON and OFF of a function of at least one of the illuminance sensors 1 and 2. Accordingly, the sensors can be used correspondingly to various environments, and it is possible to realize brightness and image quality control adapted to an adaptation state of eyes of an observer.

Further, according to the first preferred embodiment of the present invention, in the display device, fixed values set in advance are set to the backlight brightness correction coefficients 1 and 2, the black level correction coefficients 1 and 2 and the saturation correction coefficients 1 and 2, which are control values corresponding to the illuminance sensors 1 and 2 set to be OFF in the ON/OFF switching 53 for the illuminance sensor 1 on the front surface and the ON/OFF switching 54 for the illuminance sensor 2 on the rear surface being the first switching unit. Accordingly, the sensors can be used correspondingly to various environments, and it is possible to realize brightness and image quality control adapted to an adaptation state of eyes of an observer.

Further, according to the first preferred embodiment of the present invention, the display device further includes the outside light setting 51 and the distance setting 52 as the setting units which set information indicating a positional relationship between the display 100 and an external lighting source. Accordingly, it is possible to change contributions or the like of the sensors correspondingly to various environments, and to realize brightness and image quality control adapted to an adaptation state of eyes of an observer.

Further, according to the first preferred embodiment of the present invention, in the display device, the outside light setting 51 and the distance setting 52 also set information indicating the distance between the display 100 and the outer wall. Accordingly, it is possible to realize brightness and image quality control adapted to various environments and an adaptation state of eyes of an observer.

Further, according to the first preferred embodiment of the present invention, the display device further includes the switching unit 4 as the second switching unit which switches the operation mode of the brightness control unit, the black level control unit and the saturation control unit and the control settings of the main and sub-reference tables (5*a* and 5*b* to 7*a* and 7*b*) in accordance with the positional relationship between the display 100 and the external lighting source and the distance between the display 100 and the outer wall. Accordingly, it is possible to switch to the suitable reference table adapted to various environments, and to realize brightness and image quality control adapted to an adaptation state of eyes of an observer.

Further, according to the first preferred embodiment of the present invention, in the display device, the above-mentioned control settings are control settings for switching the correspondence between the illuminance sensor 1 and the reference tables 5*a*, 6*a* and 7*a* which are the third reference table and the reference tables 5*b*, 6*b*, and 7*b* which are the fourth reference table and a correspondence between the illuminance sensor 2 and the reference tables 5*a*, 6*a* and 7*a* which are the third reference table and the reference tables 5*b*, 6*b*, and 7*b* which are the fourth reference table. Accordingly, it is possible to switch to the suitable reference table adapted to various environments, and to realize brightness and image quality control adapted to an adaptation state of eyes of an observer.

B. Second Preferred Embodiment

(B-1. Configuration)

A second preferred embodiment of the present invention relates to a display system including a plurality of the display devices according to the first preferred embodiment. The respective display devices are capable of performing outside light correction processing in a similar manner to the display device according to the first preferred embodiment, and a user selects one thereof as described below and sets the selected one as a master. In that case, other devices are set as slaves, and the plurality of display devices are capable of communicating with each other through a network.

(B-2. Operation)

Figure 16:
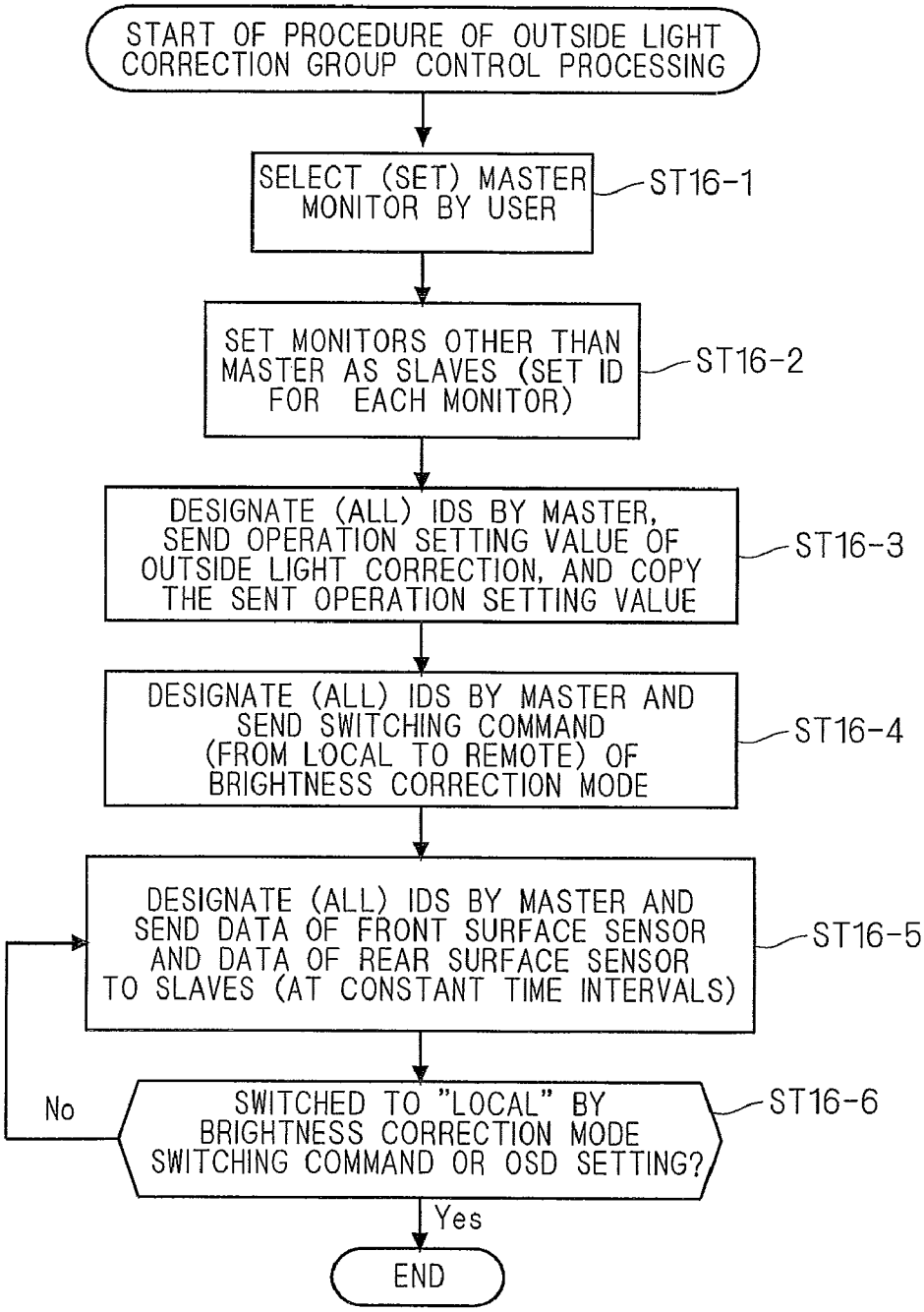
FIG. 16 is a flowchart showing an entire operation of a group control processing according to the second preferred embodiment of the present invention.

FIG. 16 is a flowchart showing a procedure of an outside light correction group control processing in the case where the plurality of display devices are connected to each other according to the second preferred embodiment.

Figure 15:
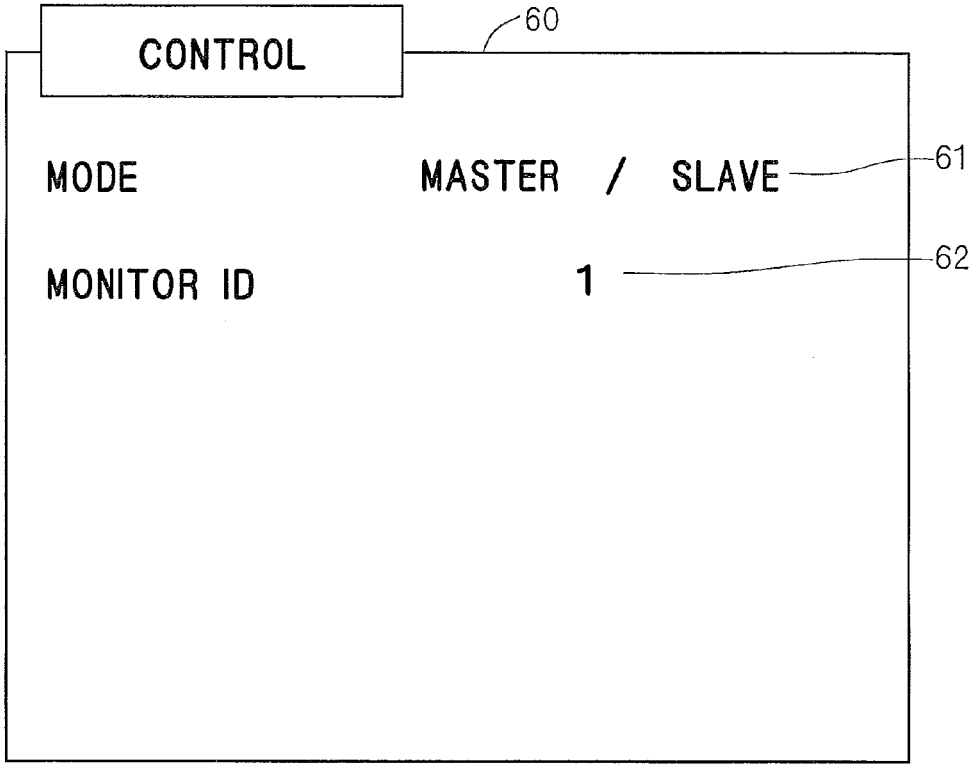
FIG. 15 is a diagram showing an example of an OSD menu for communication function setting according to a second preferred embodiment of the present invention.

First, the user selects one of the plurality of display devices and sets the selected one as a master (one display device of the plurality of display devices) in mode selection 61 of an OSD menu 60 shown in FIG. 15. A monitor ID in this case is set so that a default value is 1 (Step ST16-1). Next, slaves are all selected in the other display devices, and individual IDs (other than one set to the master) are set to the respective display devices (Step ST16-2).

Next, in Step ST16-3, setting parameters for respective operations set in FIG. 5 are all distributed from the display device being as a master to the other display devices being as slaves, and the settings are copied.

Next, in Step ST16-4, a switching command of a brightness correction mode is sent from the display device being as a master to the other display devices being as slaves, and the other display devices are caused to be in a remote mode. The display devices set to be in the remote mode use the measurement results of data on the front surface and the rear surface sent by the master in place of a measurement result of a built-in sensor.

Next, measurement results of data of the illuminance sensors 1 and 2 on the front surface and the rear surface are distributed by a distribution unit (not shown) from the master to all the slaves (Step ST16-5).

Step ST16-5 is repeated until brightness correction mode switching (from remote to local) is performed from the master to the slaves (Step ST16-6).

Figure 17:
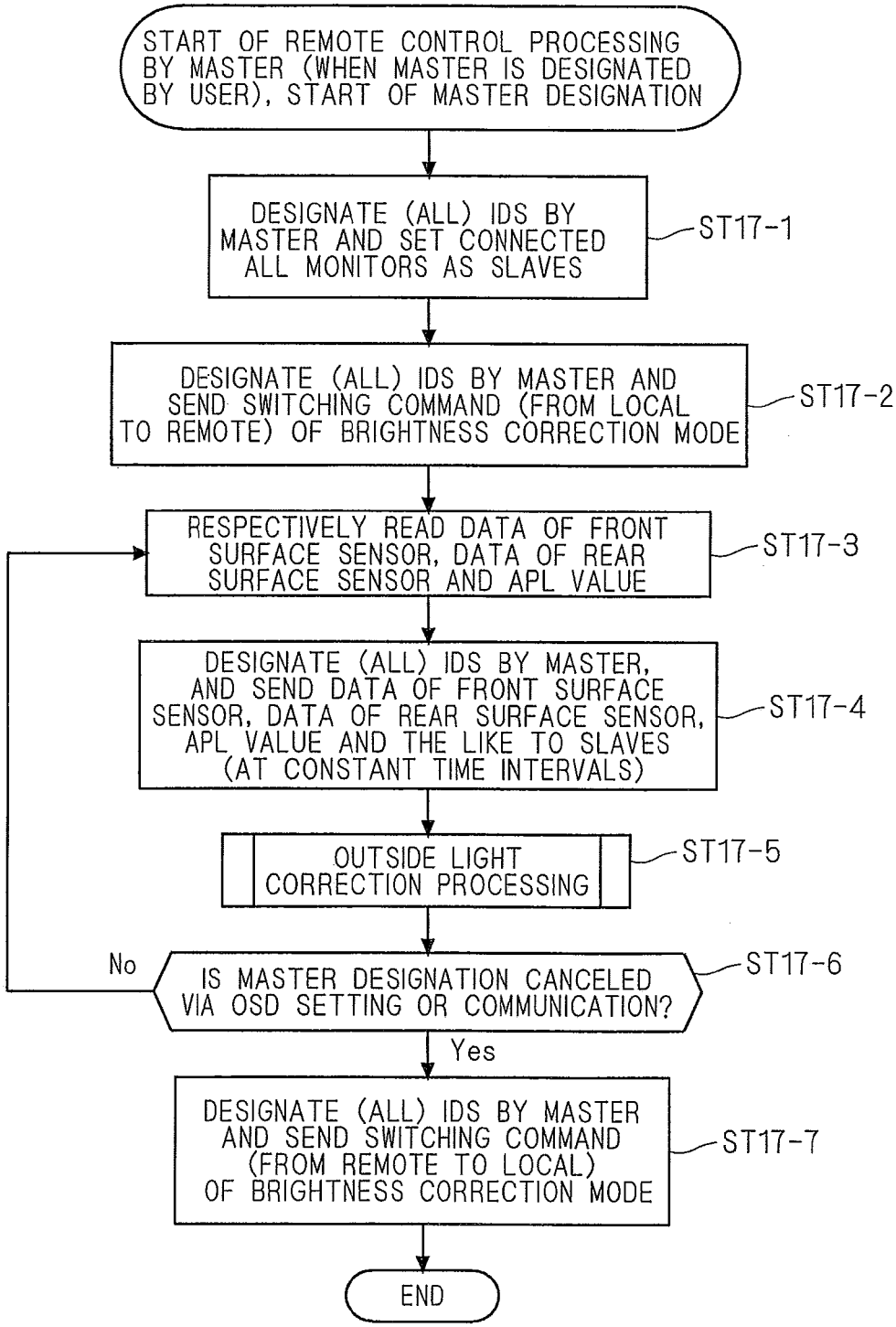
FIG. 17 is a flowchart showing an operation of a master display device in the group control processing according to the second preferred embodiment of the present invention.

FIG. 17 is a flowchart showing an operation procedure of the display device which is designated as a master in the outside light correction group control processing in the case where the plurality of display devices according to the second preferred embodiment are connected.

In FIG. 17, the display device designated as a master by the user sets communication modes of the other all connected display devices as slaves (Step ST17-1).

Next, the display device designated as a master sends a command for switching the mode of brightness correction control from LOCAL to REMOTE to the other all connected display devices (Step ST17-2).

Next, the display device designated as a master respectively reads measurement data of the illuminance sensor 1 on the front surface and measurement data of the illuminance sensor 2 on the rear surface thereof and an APL value (Step ST17-3).

Next, the display device designated as a master distributes related control setting parameters (such as position of a light source, distance with the wall surface and ON/OFF setting of a sensor) in addition to the measurement data of the sensors and APL value read in Step ST17-3 to the other all connected display devices (Step ST17-4).

Next, the display device designated as a master performs the outside light correction processing as described above based on the measurement result of the sensor thereof (Step ST17-5).

Next, the display device designated as a master checks whether or not master designation in a communication mode is canceled via OSD setting or a communication command. If the master designation is not canceled, the process returns to Step ST17-3 (Step ST17-6).

If the master designation is canceled in the above-mentioned Step ST17-6, the display device designated as a master sends a command for switching a mode of brightness correction control from REMOTE to LOCAL to the other all connected display devices (Step ST17-7).

As described above, according to the second preferred embodiment of the present invention, the display device designated as a master acts so that the other all connected display devices operate under the same condition.

Note that in the operation shown in FIG. 17, it is possible to employ a method of obtaining the measurement results of the illuminance sensors 1 and 2 on the front surface and the rear surface of the other display device by an obtaining unit (not shown) of the display device designated as a master, performing an averaging procedure or the like, and then sending, by the display device designated as a master, a command to other display devices. In that case, in the operation of the display devices designated as slaves, which will be described below, there is required an operation of sending the measurement results of the illuminance sensors to the display device designated as a master.

Figure 18:
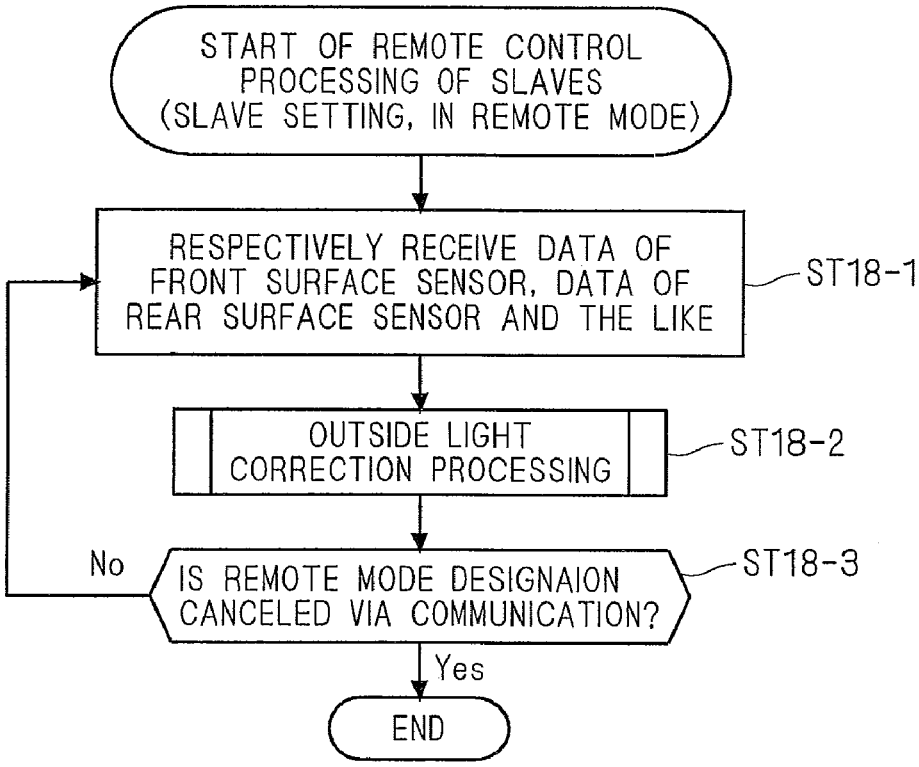
FIG. 18 is a flowchart showing an operation of a slave display device in the group control processing according to the second preferred embodiment of the present invention.

FIG. 18 is a flowchart showing an operation procedure of the display devices designated as slaves in the outside light correction group control processing in the case where a plurality of the display devices according to second preferred embodiment are connected.

In FIG. 18, the display device designated as a slave receives setting parameter information such as sensor data and APL data distributed from the display device designated as a master in the above-mentioned Step ST17-4 (Step ST18-1).

Next, the display device designated as a slave performs the outside light correction processing by a control unit (not shown) as a second control unit based on the parameters received in the above-mentioned Step ST18-1 (Step ST18-2). Note that it is assumed that in a case where the display device designated as a master includes the above-mentioned obtaining unit, sensor data is sent to the display device designated as a master, and the outside light correction processing, which is based on the setting parameter information such as the sensor data and the APL data measured by the first and second measuring units of the display device designated as a master and the other display device, is performed by a control unit (not shown) as a third control unit.

The above-mentioned control unit as the second control unit and control unit as the third control unit perforin the outside light correction processing by functions (brightness control unit, black level control unit, saturation control unit and the like) of the control unit 101 being the first control unit.

Next, it is checked whether or not the mode of the brightness correction control is canceled from REMOTE to LOCAL by a communication command, and if the remote mode is not canceled, the process returns to Step ST18-1 (Step ST18-3).

If the remote mode is canceled in Step ST18-3, the process is finished.

The display device according to the second preferred embodiment operates as described above.

(B-3. Effects)

According to the second preferred embodiment of the present invention, in the display system including a plurality of display devices, the display device designated as a master, which is one display device among the plurality of display devices, includes the distributing unit which distributes at least the measurement result on illuminance of the illuminance sensor 1 or the measurement results on illuminance of the illuminance sensors 1 and 2 of the display device designated as a master to the display devices designated as slaves, which are other display devices. In addition, the display devices designated as slaves among the plurality of display devices each include the second control unit which performs brightness control on the images displayed on the displays 100 of the display devices designated as slaves in accordance with the distributed measurement result on illuminance Accordingly, the display device designated as a master can distribute the measurement data and setting information of the optical sensors of a specific display device to the other devices using a communication function, and the other devices can perform the outside light correction operation based on the distributed information. As a result, there is performed brightness control corresponding to setting corresponding to an installation environment, to thereby realize brightness and image quality control adapted to an adaptation state of eyes of an observer. Further, it is possible to perform brightness control optimum to cases under various setting environments. Moreover, even in a case where a single screen is composed of a plurality of display device groups, measurement results on light and various setting contents of one display device are shared within the group, to thereby realize brightness control free from unevenness in the screen.

Further, according to the second preferred embodiment of the present invention, in the display system including a plurality of display devices, the display device designated as a master, which is one display device among the plurality of display devices, includes an obtaining unit (not shown) which obtains at least the measurement results on illuminance of the illuminance sensors 1 or the measurement results on illuminance of the illuminance sensors 1 and 2 of the display devices designated as slaves, which are the other display devices among the plurality of display devices, and a third control unit (not shown) which performs brightness control on the images displayed on the displays 100 of the plurality of display devices in accordance with the measurement results obtained by the obtaining unit and the measurement results of the illuminance sensors 1 and 2 of the display device designated as a master. Accordingly, the display device designated as a master can receive and distribute measurement data and various setting information of the optical sensors of a specific display device using a communication function, and the other display devices can respectively perform the outside light correction operation based on the distributed information. As a result, there is performed brightness control corresponding to setting corresponding to an installation environment, to thereby realize brightness and image quality control adapted to an adaptation state of eyes of an observer. Further, it is possible to perform brightness control optimum to cases under various setting environments. Moreover, even in a case where a single screen is composed of a plurality of display device groups, measurement results on light and various setting contents of the plurality of display devices are used within the group in a unified manner, to thereby realize brightness control free from unevenness in the screen.

C. Third Preferred Embodiment (C-1. Configuration)

Figure 19:
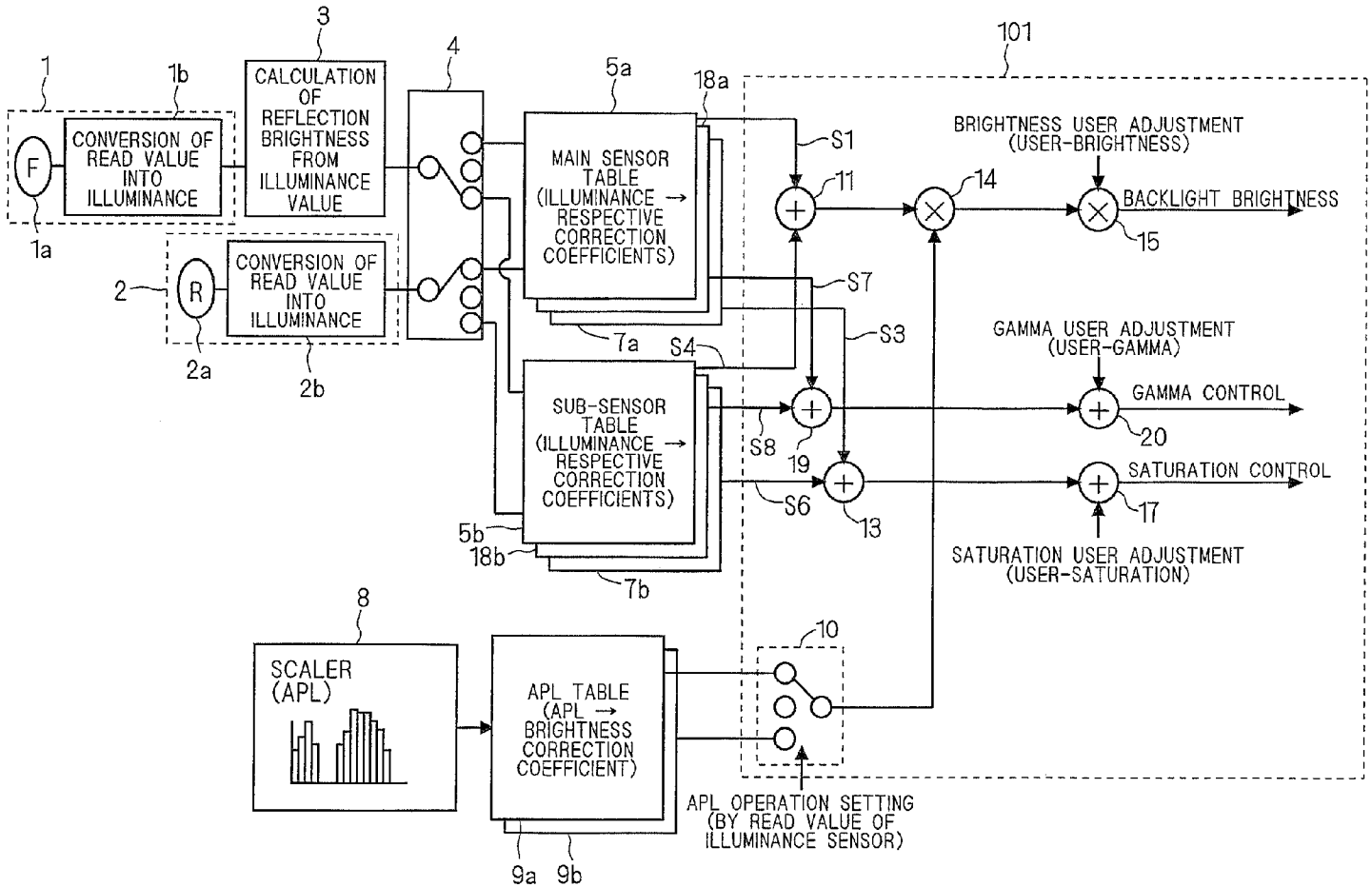
FIG. 19 is a system configuration diagram of a display device according to a third preferred embodiment of the present invention.
Figure 20:
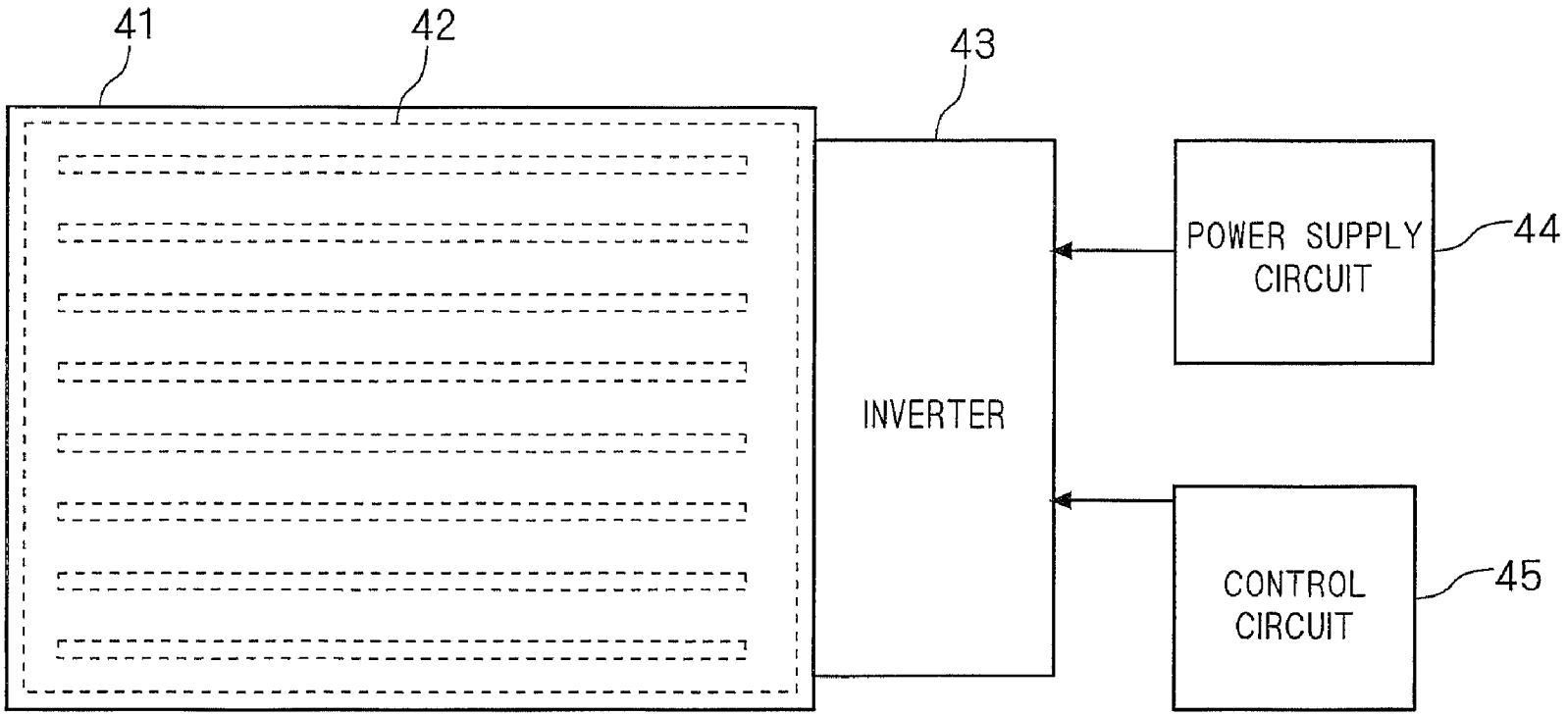
FIG. 20 (BACKGROUND ART)
FIG. 20 is a configuration diagram showing a conventional brightness control system.
Figure 21:
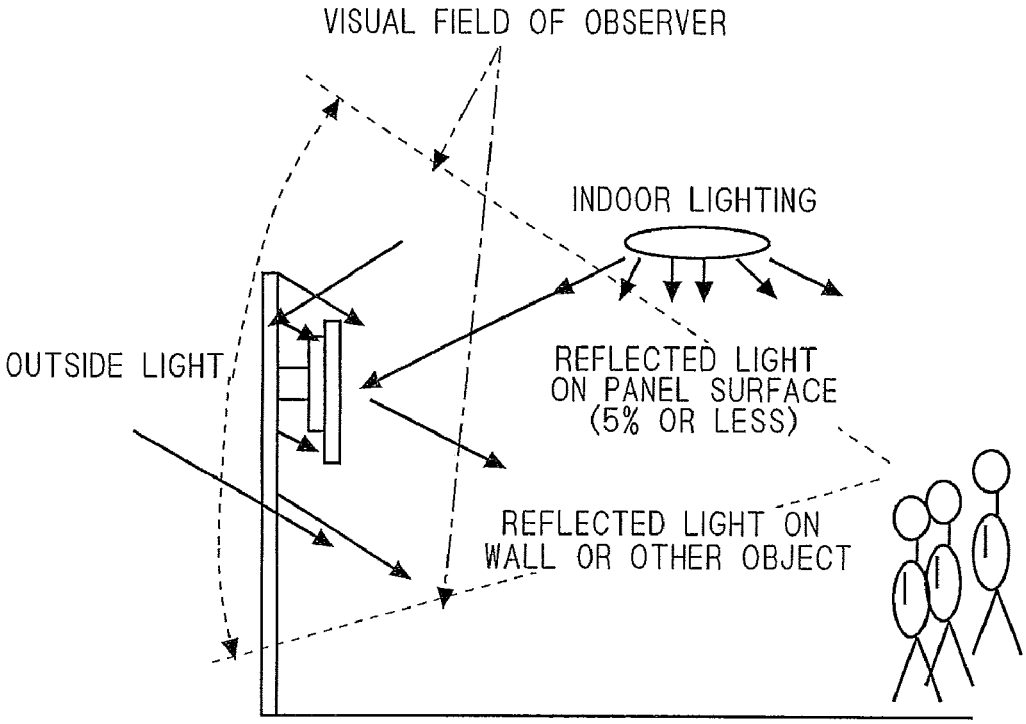
F I G . 2 1 (BACKGROUND ART)
FIG. 21 is a schematic diagram showing an example of a relation between an installation environment of a conventional large display for information display and a visual environment of an observer.
Figure 22:
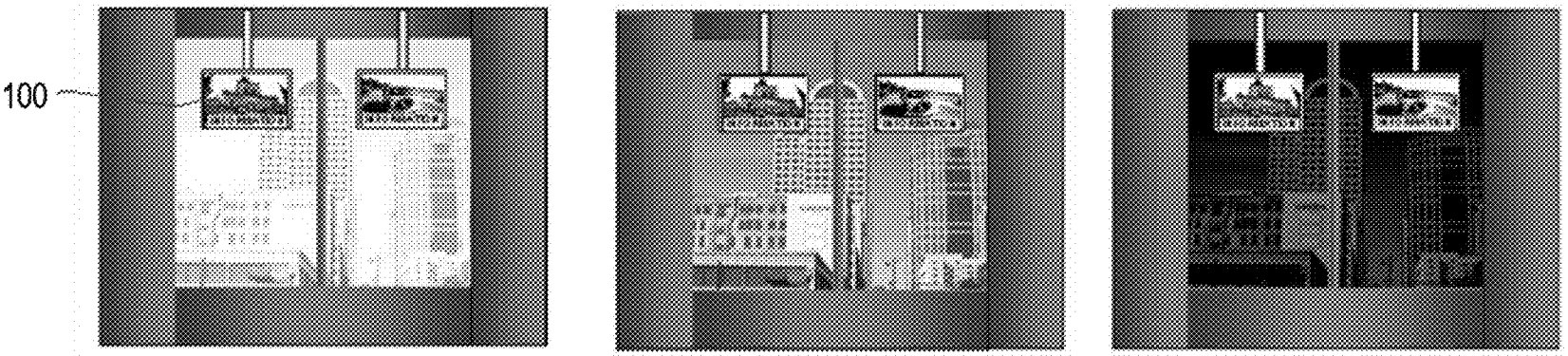
FIG.22 BACKGROUND ART
FIG. 22 is a diagram showing an example of a change in outside light of the conventional large display for information display.

FIG. 19 is a view showing a configuration of a display device according to a third preferred embodiment of the present invention. The third preferred embodiment is different from the first preferred embodiment in that a gamma correction value is changed in place of changing the black level correction value, and other configuration and operation are similar to those of the first preferred embodiment.

Note that though brightness, black level, gamma and saturation are described as examples of parameters for image control in the first to third preferred embodiments, other parameters such as sharpness may be described as an example.

A gamma main reference table 18*a* and a gamma sub-reference table 18*b* are provided for referring to a gamma correction coefficient of a display by a brightness value or illuminance value on the front surface or the rear surface, and a correspondence between the gamma main reference table 18*a* and the illuminance sensors 1 and 2 and a correspondence between the gamma main reference table 18*b* and the illuminance sensors 1 and 2 are changed in accordance with a state of operation setting.

A gamma calculating unit 19 is provided for performing weighted addition on the gamma correction coefficients 1 and 2 determined by the gamma main reference table 18*a* and the gamma sub-reference table 18*a* together to determine the gamma correction value.

(C-2. Operation)

Based on the measurement results of the illuminance sensors 1 and 2 installed on the front surface and the rear surface, respectively, brightness and the like are controlled using the respective reference tables.

The gamma correction coefficients 1 and 2 are determined by a method similar to that of determining the correction coefficients (1, 2) using the reference tables 6*a* and 6*b* of black level according to the first preferred embodiment, to thereby determine the gamma correction value. Details thereof are similar to those of the first preferred embodiment, and their description will be omitted.

(C-3. Effects)

According to the third preferred embodiment of the present invention, in the display device, the gamma control unit of the control unit 101 as the first control unit performs gamma control on the images displayed on the display 100 in accordance with the measurement result of at least one of the illuminance sensors 1 and 2. As a result, screen brightness can be controlled mainly by the illuminance sensor 2 of the illuminance sensors 1 and 2 which are installed on the front surface and the rear surface of the display device, respectively, and further gamma control can be enabled. Accordingly, it is possible to perform brightness and gamma control adapted to an illuminance environment.

Further, according to the third preferred embodiment of the present invention, the display device further includes the gamma main reference table 18*a* as the third reference table and the gamma sub-reference table 18*b* as the fourth reference table which are used in setting of the gamma correction coefficients 1 and 2 which are the second control values in gamma control. In addition, the illuminance sensors 1 and 2 are made to correspond to the reference table 18*a* and the reference table 18*b* in an exchangeable manner, and the gamma control unit of the control unit 101 being the first control unit performs the gamma control by the gamma correction coefficients 1 and 2 set in the reference table 18*a* and the reference table 18*b*. Accordingly, it is possible to realize brightness, saturation and image quality control adapted to various environments and an adaptation state of eyes of an observer.

Further, according to the third preferred embodiment of the present invention, the display device further includes the calculating unit 3 which calculates reflection brightness on the front surface from the measurement result of the illuminance sensor 1 being the second calculating unit. In addition, the gamma control unit of the control unit 101 being the first control unit performs gamma control on the images displayed on the display 100 in accordance with the result of at least one of the illuminance sensor 1 and the calculating unit 3. Accordingly, it is possible to realize brightness, saturation and image quality control which adapted to various environments and an adaptation state of eyes of an observer.

As an application example of the present invention, the present invention is applicable to an on-vehicle display device (car navigation system), a household TV receiver and the like, in addition to a large display device (public display) used for public purpose.

While the invention has been shown and described in detail, the foregoing description is in all aspects illustrative and not restrictive. It is therefore understood that numerous modifications and variations can be devised without departing from the scope of the invention.

What is claimed is:

1. A display device, comprising:

a display surface provided on a front surface of said display device, on which images are displayed;

a first measuring unit provided on a rear surface of said display device and measuring illuminance on said rear surface;

a first control unit performing brightness control on said images displayed on said display surface in accordance with a measurement result of said first measuring unit, a second measuring unit provided on said front surface of said display device and measuring illuminance on said front surface; and a calculating unit calculating reflection brightness on said front surface from said measurement result of said second measuring unit, wherein said first control unit performs said brightness control, black level control, gamma control and saturation control on said images displayed on said display surface in accordance with at least one of said measurement result of said first measuring unit and a result of said calculating unit, wherein said first control unit performs said brightness control on said images displayed on said display surface in accordance with at least one of said measurement result of said first measuring unit and a measurement result of said second measuring unit.

2. The display device according to claim 1, wherein said first control unit performs black level control on said images displayed on said display surface in accordance with said measurement result of said at least one of said first and second measuring units.

3. The display device according to claim 1, further comprising a unit measuring an average picture luminance gradation level of said images, wherein said first control unit performs said brightness control on said images displayed on said display surface in accordance with said average picture luminance gradation level.

4. The display device according to claim 3, further comprising first and second reference tables used in setting of a first control value corresponding to said average picture luminance gradation level, wherein said first and second reference tables are selected in accordance with said measurement result of said at least one of said first and second measuring units, wherein said first control unit performs said brightness control on said images displayed on said display surface also in accordance with said first control value set in said selected first and second reference tables.

5. The display device according to claim 1, wherein said first control unit performs gamma control on said images displayed on said display surface in accordance with said measurement result of said at least one of said first and second measuring units.

6. The display device according to claim 1, wherein said first control unit performs saturation control on said images displayed on said display surface in accordance with said measurement result of said at least one of said first and second measuring units.

7. The display device according to claim 1, further comprising third and fourth reference tables used in setting of a second control value in at least any one of said brightness control, black level control, gamma control and saturation control of said images, wherein said first and second measuring units are made to correspond to said third and fourth reference tables in an exchangeable manner, wherein said first control unit performs said at least any one of said brightness control, said black level control, said gamma control and said saturation control by said second control value set in said third and fourth reference tables.

8. The display device according to claim 1, further comprising first switching units switching between ON and OFF of a function of said at least one of said first and second measuring units.

9. The display device according to claim 8, wherein a control value corresponding to one of said first and second measuring units set to be OFF by said first switching units is a fixed value set in advance.

10. The display device according to claim 7, further comprising setting units setting information indicating a positional relationship between said display surface and an external lighting source.

11. The display device according to claim 10, wherein said setting units also set information indicating a distance between said display surface and an outer wall.

12. The display device according to claim 11, further comprising a second switching unit switching control setting of an operation mode of said first control unit in accordance with said positional relationship between said display surface and said external lighting source and said distance between said display surface and said outer wall.

13. The display device according to claim 12, wherein said control setting is control setting for switching a correspondence between said first measuring unit and said third and fourth reference tables and a correspondence between said second measuring unit and said third and fourth reference tables.

14. A display system, comprising a plurality of display devices each including:

a display surface provided on a front surface of said display device, on which images are displayed;

a first measuring unit provided on a rear surface of said display device and 20 measuring illuminance on said rear surface;

a first control unit performing brightness control on said images displayed on said display surface in accordance with a measurement result of said first measuring unit; and a second measuring unit provided on a front surface of said display device and measuring illuminance on said front surface, wherein one display device among said plurality of display devices includes a distributing unit distributing, to said plurality of display devices other than said one display device, at least one of said measurement result on illuminance of said first measuring unit, and the measurement result on illuminance of said first measuring unit and a measurement result on illuminance of said second measuring unit of said one display device, wherein said plurality of display devices other than said one display device each include a second control unit performing said brightness control on said images displayed on said display surface of said plurality of display devices other than said one display device in accordance with said distributed measurement result on illuminance.

15. A display system, comprising a plurality of display devices each including:

a display surface provided on a front surface of said display device, on which images are displayed;

a first measuring unit provided on a rear surface of said display device and measuring illuminance on said rear surface;

a first control unit performing brightness control on said images displayed on said display surface in accordance with a measurement result of said first measuring unit; and a second measuring unit provided on a front surface of said display device and measuring illuminance on said front surface, wherein one display device among said plurality of display devices includes:

an obtaining unit obtaining at least one of said measurement result on illuminance of said first measuring unit, and said measurement result on illuminance of said first measuring unit and a measurement result on illuminance of said second measuring unit of each of said plurality of display devices other than said one display device; and a third control unit performing said brightness control on said images displayed on said display surface of said plurality of display devices in accordance with said measurement result obtained by said obtaining unit and said measurement results of said first and second measuring units of said one display device.

16. The display system according to claim 15, further comprising:

a communication unit configured to receive measurement data from a master display device and wherein the first control unit performs brightness control based on the received measurement data if in a remote mode and based on the measurement result of said first measuring unit if in a local mode.

* * * * *